US012768626B2

(12) United States Patent
Gallus et al.

(10) Patent No.: US 12,768,626 B2
(45) Date of Patent: Oct. 20, 2026

(54) SEPARATION SYSTEM WITH SHEAR PLATES

(71) Applicants: David Michael Gallus, Las Cruces, NM (US); Timothy David Gallus, Las Cruces, NM (US); Rachel Chiwan Gallus, Las Cruces, NM (US); Robert Michael Gallus, Las Cruces, NM (US)

(72) Inventors: David Michael Gallus, Las Cruces, NM (US); Timothy David Gallus, Las Cruces, NM (US); Rachel Chiwan Gallus, Las Cruces, NM (US); Robert Michael Gallus, Las Cruces, NM (US)

( * ) Notice: Subject to any disclaimer, the term of this patent is extended or adjusted under 35 U.S.C. 154(b) by 162 days.

(21) Appl. No.: 18/912,477

(22) Filed: Oct. 10, 2024

(65) Prior Publication Data

US 2025/0035415 A1 Jan. 30, 2025

Related U.S. Application Data

(62) Division of application No. 17/721,712, filed on Apr. 15, 2022, now Pat. No. 12,181,259.

(51) Int. Cl.
*F42B 15/34* (2006.01)
*F42B 15/36* (2006.01)

(52) U.S. Cl.
CPC ..... *F42B 15/36* (2013.01)

(58) Field of Classification Search
CPC ..... F42B 15/36; F42B 15/10
USPC ..... 225/2, 94, 96
See application file for complete search history.

(56) References Cited

U.S. PATENT DOCUMENTS

| | | | | | |
|---|---|---|---|---|---|
| 3,373,686 | A * | 3/1968 | Blain | F42B 3/093 | 89/1.14 |
| 4,685,376 | A * | 8/1987 | Noel | F42B 15/38 | 60/632 |
| 5,310,104 | A * | 5/1994 | Zaidel | B28D 5/0052 | 225/2 |
| 5,372,071 | A * | 12/1994 | Richards | B64G 1/6455 | 102/378 |
| 5,392,684 | A * | 2/1995 | Renfro | F42B 15/38 | 102/378 |
| 5,969,287 | A * | 10/1999 | Blain | F42B 15/38 | 102/378 |
| 5,992,328 | A * | 11/1999 | Blain | F42B 15/38 | 102/378 |
| 6,125,762 | A * | 10/2000 | Fritz | F42B 15/38 | 102/378 |
| 6,298,786 | B1 * | 10/2001 | Grosskrueger | F42B 15/38 | 102/377 |
| 10,801,822 | B2 * | 10/2020 | Wilson | F42B 33/008 | |
| 12,181,259 | B2 * | 12/2024 | Gallus | F42B 15/36 | |
| 2015/0246854 | A1 * | 9/2015 | Kametz | C06C 5/04 | 102/275.1 |

(Continued)

*Primary Examiner* — Omar Flores Sanchez

(57) ABSTRACT

A separation device assembly with efficiency that allows for multi-fault-tolerance. The separation device assembly comprising an inflation device that applies force to a shear plate assembly. The shear plate assembly focuses force in the optimal leg locations for efficient shearing of the frangible portions. The separation device assembly further comprising a means for limiting excess movement after fracture so that residual energy from the inflation device is applied to non-fractured portions of the assembly.

19 Claims, 21 Drawing Sheets

(56) References Cited

U.S. PATENT DOCUMENTS

| | | | | |
|---|---|---|---|---|
| 2023/0093642 | A1* | 3/2023 | Swanson | F42B 15/10<br>60/219 |
| 2023/0332876 | A1* | 10/2023 | Gallus | F42B 15/36 |
| 2025/0035417 | A1* | 1/2025 | Gallus | F42B 15/36 |

* cited by examiner

SEPARATION SYSTEM WITH SHEAR PLATES

CROSS-REFERENCE TO RELATED APPLICATIONS

This application is a divisional of U.S. patent application Ser. No. 17/721,712 filed on Apr. 15, 2022, entitled "Multi-Fault Tolerant Separation System", which is incorporated by reference herein in its entirety.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

REFERENCES AND OTHER PUBLICATIONS

"Quasi-Static Fracture Toughness Testing Of 7075 Aluminum For Spacecraft Separation Joint Applications" by Ilse Alcantara, University of Texas at El Paso, Jan. 1 2017.

"Deterministic System Design of Experiments Based Frangible Joint Design Reliability Estimation" by T. Scott West, NASA/NESC; Martin S. Annett, NASA LaRC; James M. Womack, The Aerospace Corporation.

BACKGROUND OF THE INVENTION

The subject matter disclosed herein generally relates to separation device assemblies, and more particularly, to modular frangible joint separation device assemblies. A typical configuration of a prior art separation device assembly contains a clevis assembly consisting of an upper central plate known of as a clevis and two frangible portions. Both frangible portions have a groove, either milled or is integrally formed, which act as stress risers and establish the desired fracture planes. This clevis assembly is bolted to a lower central plate, known of as a tang, through the lower parts of the frangible portions. Between the two frangible portions and the clevis and tang plates an expansion cavity is formed, wherein an inflation device is placed. Upon activation of the inflation device the frangible portions fracture and separate the clevis from the tang.

Modular frangible joint separation device assemblies have been used by the military and aerospace industries for over fifty years in many different applications including multi-staged spacecraft booster separations, payload separations, door and fairing jettisoning, and shroud removal. Their popularity has grown over the years as the industry has migrated away from frangible techniques that produce uncontained space debris, such as exploding bolts and shape charges. These techniques generated a lot of space debris due to the shattering effects of high explosives. The definition of "explosive" includes any chemical compound or mechanical mixture which, when subjected to heat, impact, shock, friction, electrical energy, or other suitable stimuli, undergoes a very rapid chemical change with the production of a large volume of highly heated gases that exert pressure on the surrounding medium.

To solve the space debris problem, the debris from explosions were contained within an inflatable device called an Expansion Tube Assembly (XTA), which was introduced and first patented by Blain and Leaman in U.S. Pat. No. 3,373,686. An XTA typically comprises a flattened seamless metal tube with a major axis that is parallel to the legs of the frangible portions. Inside this containment tube is an elastomeric Charge Holder (CH) which supports a linear explosive charge generally in the center of the XTA. The explosive is known of as a Mild Detonating Cord (MDC) also sometimes referred to as a Mild Detonating Fuse.

One kind of explosion is known of as detonation where the reaction proceeds through a material faster than the speed of sound. During a detonation, the original explosive material volume increases approximately ten thousand times in approximately thirty microseconds. Such intense pressurization rates create a shattering effect known of as brisance which is necessary for demolition actions. Before the use of XTAs, high brisance was usually necessary because those devices relied on the shattering effect of shape charges. High explosives also create shock wave harmonics that may assist in the fracturing of frangible assemblies. However, these effects are highly sensitive to environmental variations and therefore shouldn't be relied upon as a controlling factor for joint separation. Having evolved from explosive shape charge shattering technology, this philosophy of dynamic behavior has dominated the past fifty years of prior art development.

All prior art has specified MDC explosive materials with a high velocity of detonation and high brisance shattering effects, typically Hexanitrostilbene (HNS), High Melting Explosive (HMX), or Pentaerythritol Tetranitrate (PETN) as the driver for XTA internal pressure development. However, shattering impulses can create conditions counter to the design criteria of new separation systems since XTAs were integrated into frangible joints to encapsulate explosion byproducts and prevent the creation of space debris.

Multistage rockets require many frangible joint assemblies to hold the various stages of the rocket together until the time for separation occurs. When the separation devices malfunction, they almost certainly guarantee mission failure. On unmanned missions this is expensive, but on manned space missions it can cost the lives of the flight crew. For this reason, NASA has published fault-tolerant and redundancy specifications for all Human Rated Pyrotechnic procurements, in which it is outlined what systems may be zero fault tolerant and which ones are required to be single fault tolerant. A system is classified as zero fault tolerant if when one part of the explosive chain fails then the device fails, and therefore has no redundancy. Prior art designs remain nearly zero fault tolerant. Single fault tolerant is classified as a system in which one explosive chain can fail, and a second can fire and complete the mission. A two fault tolerant system is one in which two out of three explosive chains can fail and a third can complete the mission. While NASA specifies single fault tolerant systems for critical human space flight components, two fault tolerant systems are usually only specified for life support systems.

Frangible joints are bounded by many design constraints, as seen in FIG. 1. First, the device must be strong enough to stay assembled while subjected to launch forces, which is represented as structural strength. Second, a reasonable margin above structural strength must be maintained to ensure reliability and avoid structural failure. Third, the combustible load must be adequate to completely separate the stages at the proper time with a margin to ensure reliability. The theoretical strength to shear all fracturable planes of the frangible joint, known of as ligaments, sets the lower bound. In FIG. 1 the theoretical strength needed to fracture all ligaments of a one-foot section of a frangible joint that has a ligament thickness of 0.07" is approximately 0.2 grains per foot of HNS, assuming that 100% of the combustion energy is applied to ligament fracture. However, this theoretical minimum is impossible to achieve because work is always lost to other mechanisms such as leg bending during joint activation. These inefficiencies increase the apparent strength over theoretical strength since more combustion energy is required for the joint to function properly. Apparent strength is shown on the X axis at a position much greater than theoretical.

Before the use of XTAs, no upper bound existed for the combustion energy and so the operating range was open ended. In other words, reliability-to-separate problems could be remedied by adding more explosive to the MDC. However, due to the implementation of XTAs, an upper energy boundary now exists, which cannot exceed the XTA strength. A reasonable margin for manufacturing and environmental variations lowers this upper boundary even more. Now the fracturing of all ligaments down the entire frangible assembly must be accomplished in a greatly diminished operational window. FIG. 1 graph shows the bounding conditions of prior art designs. The probability of occurrence is plotted on the Y axis and material strength and combustible load is expressed as grains per foot (gr/ft) of an MDC filled with HNS plotted on the X axis, since the most common explosive material used in MDCs has been HNS. This graph shows the main problems with prior art designs in that prior art operates in a very narrow operational window between apparent joint strength and XTA strength. The structural strength curve shown on the left indicates the strength of the joint needed to withstand launch forces and keep the stages connected. The next curve labeled as theoretical strength is the shear strength of two ligaments of 7075-T6 aluminum that are one foot long. Since combustion energy must satisfy inefficient operations in parallel with ligament fracture, the apparent strength of the ligament is approximately 24 (gr/ft). Some of the time these losses are composed of reversible and irreversible work due to clastic and plastic deformation of the parts of the frangible portions that are pressed upon by the XTA, which are referred to as the legs. The load of the MDC has to fit within the apparent ligament strength centered at 24 (gr/ft) and the XTA strength threshold centered at 33 (gr/ft).

Frangible joint reliability can be predicted by comparing the overlapping area of the energy it takes to fracture a frangible joint with the energy provided by the combustible load though the XTA, minus losses. The trailing edges of these curves reflect real-world manufacturing variations. It is obvious that too narrow of an operating range forces these trailing edges of the curves to overlap so much that 99.95% reliability of full ligament fracture along with avoidance of XTA rupture is not possible. 99.95% reliability is equivalent to approximately three sigma quality control and is a difficult manufacturing standard to achieve for an assembled device. The area of overlap between these two curves is known as the failure to fracture region. Uncontrollable environmental variations such as wind load changes, launch temperatures, differential temperatures across a joint, and space temperatures determine that trailing edge overlaps at a probability greater than allowed by 99.95% reliability. Until recently this has allowed for a failure rate that has been expensive but acceptable for un-manned flight. Two satellite launches, namely the GLORY and the OCO, each experienced frangible joint failures which resulted in the loss of both missions. Together those two failures cost approximately one billion U.S. dollars. While it may be possible to narrow prior art design manufacturing variations, environmental variations may never be reduced enough to yield total frangible joint reliabilities which meet NASA standards.

Prior art has gone through many design changes over the years in an attempt to reduce this failure region. Studies by T. Scott West, et al. have analyzed microscopic differences in air gaps in an attempt to find metrics which can improve the reliability and redundancy of prior art. Extensive computer modeling of shock wave harmonics and finite element analysis utilizing Monte Carlo simulations of prior art have even been undertaken to refine these designs further.

However, all of these simulations and tests have been in the same narrow field of optimization and have only produced minimal effect on ligament shear reliability. Reliability of the entire joint can only be increased if this failure region is reduced by decreasing the energy required to fracture the ligaments since the strength of the XTA is fixed and determines the upper boundary.

A second reliability problem with prior art occurs in the explosive chain of the MDC. Relatively low reliability in the chain dictates that multiple MDCs should be used to create redundancy for the pressure production within the XTA. However, the narrow operational window of prior art determines that only one combustible load can be placed within an XTA without rupture. Since the combustible load energy must be above the apparent joint strength but below the XTA strength limit, and the delta between apparent strength and the load takes up most of the operational window, there is no operating space left to fit in a second combustible load. These limitations render prior art designs below a reliability of 99.95% and barely zero fault tolerant. Without multiple MDCs, if the single explosive chain fails, the joint will not separate, and therefore is defined as zero fault tolerant. Neither the reliability nor fault tolerance of prior art designs may ever meet the specifications for human space flight.

Prior art seems to anticipate only a narrow collection of possibilities for frangible joint separation. All drawings show radial two-dimensional slices with perfect vertical plane of symmetry before function as seen FIG. 2A, and after functioning as seen in FIG. 2B. The sequence shows progress from an intact joint just before activation to a separated joint where the ligaments are fractured, and legs are bent away from a central vertical axis with perfect symmetry. This demonstrates that all prior art teaches idealized conditions of manufacturing perfection where no provisions are made for variations. This also implies an unrealistic perfect balance of force as the XTA presses on both legs and further implies that all of the forces are balanced during the MDC combustion. Since prior art doesn't anticipate these variations, it assumes that both ligaments will always fracture at the same time. Prior art only illustrates a step directly from FIG. 2A to FIG. 2B implying that perfect symmetry is maintained from beginning to end. All prior art discusses only this outcome, but it becomes obvious to anyone skilled in the art that this idealized version of a perfectly balanced fracture can theoretically never happen. When it does appear to happen, it is only because the timing between each ligament fracture, or fracture skew, is below the limit of detection. In reality due to manufacturing and temperature variations it is impossible for both ligaments to have exactly the same strength, and therefore one will always begin to fracture before the other, no matter how close the timing.

Analyses of prior art failures have pointed to slack structures as the major cause. However, prior art designs have wasted so much energy on nonessential leg work and XTA stretch that no additional movement can be tolerated by slack bolts. The use of high explosives have allowed prior art engineers to unintentionally mask design flaws. Short pressurization times from a charge distributed down the length of a joint have allowed designers the luxury of two-dimensional compartmentalized modeling of ligament fracturing. Therefore, prior art makes no provisions for ligament areas along the joint length that have not yet sheared and yet still require combustion energy to fracture properly. This is an oversimplification of the gas dynamics within an XTA which has led to design flaws.

A more realistic interpretation of the sequence of events between FIG. 2A and FIG. 2B is that there are events that are so physically small and fast that they are difficult to observe. The majority of instances of attempted ligament fracturing will occur with a timing skew from one side to the other. In most empirical tests, the ligaments fail to fracture at the same time, which is the main contributor to prior art frangible joint malfunctions. There are infinitesimally small differences that will almost always create imbalanced fracturing due to imperfect symmetry. Unrealistically homogeneous material properties in the legs and ligaments as well as geometric properties such as thickness and surface roughness are also implied by prior art. The difference in force required to fracture one ligament versus the opposite side ligament reflects the strength difference which can be attributed to varying material properties, heat treatment differences, leg thickness, ligament thickness, surface properties and inner ligament radii in the case of monolithic clevises. Furthermore, prior art does not anticipate imbalances created by manufacturing variations in crystal growth, tempering, extrusion die wear, fracture toughness, or surface conditions that lead to variations in leg and ligament tensile strength. All of the above properties exist in a range as specified by procurement specifications of real-world frangible joints and yet the designs do not anticipate nor compensate in any way for these variations.

Upon detonation of the MDC, the XTA tube inflates toward the original circular geometry as seen in FIG. 2C, and presses against both legs simultaneously. This force delivers work to bending of the legs at the center point between the upper and lower leg attachment points, and produces a combination of tensile and shear force to the ligaments to effect fracture at the fracture zones. After MDC initiation, the ligaments stretch almost evenly but there are microscopic differences that allow one ligament to shear completely. Ligament shear is not an instantaneous process. Once cracking has propagated, two rough surfaces along the shear plane are created. As the two surfaces begin to slide past one another, the roughness causes drag and restricts free movement of the leg. This dragging causes the surface of the fracture planes to smear and bend over, as illustrated by I. Alcantara. Even completely fractured ligaments drag two rough surfaces across each other until they are completely unassociated. This means that other ligament fractures are likely while the first ligament is still dragging. If a crack in the second ligament completely propagates before the first ligament completely disassociates, then complete separation is likely. In other words, once the fracturing of the second ligament is complete the leveling effect of the fractured surfaces of the first ligament dragging are no longer necessary. Next, the second ligament drags as the first leg bends out with progressively increasing force. Shortly after, the second leg bends out with progressively increasing force and mostly catches up to the first leg bend. The final configuration looks like FIG. 2B and implies that symmetry was maintained through the entire process. This case happens most of the time in prior art and until recently met the reliability needs of rocket separation joints.

The use of high explosives in prior art have also masked the skew in ligament shearing. High speed pressurization allows the second ligament to fracture while the first ligament drags in the same time frame. That temporary leveling effect allows most joints to fracture completely. If the XTA were pumped slowly, most prior art joints would fail to fracture completely. Marginal prior art designs which rely on the leveling effect of fractured ligament drag are only made functional by the speed of high explosives. This stepwise fracture phenomenon is not important when there is a large leveling effect that ensures that the remainder of the combustion energy available is applied to fracturing the unfractured ligaments. The use of high explosives creates pressurization rates that are so fast that the separation events are nearly instantaneous and therefore asymmetric fracturing doesn't warrant much consideration.

The third possible scenario of prior art is the worst case. Prior art does not anticipate an imbalance in the energy needed to fracture an inside ligament as compared to an outside ligament of a curved frangible joint, but these differences should be anticipated because the compressive strength of the frangible material is not usually the same as the tensile strength. NASA has published handbooks on frangible joints which state that this curvature effect is negligible for radii of curvatures greater than 15" which is an admission that there are differences, but that curvature is not a fracture controlling variable. Furthermore, prior art fails to anticipate temperature variations between the inner and outer ligaments, yet in the case of Aluminum 7075-T6 a temperature difference of only one hundred degrees Celsius can change the material yield strength by a factor of 1.5. Therefore, the perfect balance of ligament to ligament strength implied by prior art illustrations is almost never possible in curved joints with different temperatures. With high explosives, failure to fracture occurs rarely, but at a frequency too high for human spaceflight requirements.

In reality prior art frangible joints start out as shown in FIG. 2A and just after activation of the combustible load change their geometry to that which is seen in FIG. 2C. At this point the combustible load has been activated and has begun to fill the XTA with combustion byproducts. Here we see the XTA exerting force on both of the legs. Legs bulge almost evenly but, of course, there are minuscule differences. Gross symmetry is maintained as the MDC inflates the XTA. As we see in FIG. 2D, the drag of the first fractured ligament has ended before the fracture of the second ligament has completed, and therefore the temporary leveling effect has dissipated too soon. Without this leveling effect, it is now much easier for the combustion energy to bend the leg on the first fractured ligament and stretch the XTA than it is to fracture the second ligament. Thus, the first leg bending and XTA stretching has relaxed the shear force on the second ligament, and there will never be enough force to complete fracturing. In other words, the XTA expansion and leg bending at already fractured sites is easier to accomplish than fracture of the intact ligaments. Continued energy flow is demonstrated by the progression to FIG. 2E and energy flow in three dimensions at the fracture plane of the first ligament continues as seen in FIG. 2F. This stepwise fracture phenomenon would not be important if there was some feature in the designs which created a large leveling effect of the combustion energy application. This would ensure that the remainder of the combustion energy available was applied to fracturing the unfractured ligaments.

The nonlinear energy flow sequence described above can be compared to the inflation of a balloon. The initial linear first order inflation of a balloon requires a great deal of work to move into the second non-linear second order phase. This initial phase is analogous to the pre-fracture phase of frangible joints. While bounded and supported by the expansion cavity of a frangible assembly, inflation of an XTA requires a great deal of energy input. However, as a ligament fractures, the expansion of an XTA requires less energy input per distance of travel. This effect is seen with a balloon inflation where the initial inflation barrier is overcome and inflation proceeds with lower energy input. This in both examples is usually non-linear second order. After the balloon has assumed a mostly spherical geometry, the inflation returns to a linear first order function of energy input. This return to a linear function is caused by a combination of the tensile elongation of the XTA and the bending of the legs of the frangible assembly. This stopping force eventually acts as a secondary levelling effect after fracture surface drag, but occurs too late to assist the fracture of unfractured ligaments.

The final position of the legs shown in prior art and FIG. 2B attests to the fact that a great deal of irreversible work is performed in areas unnecessary for ligament fracture or joint push-off. Prior art shows leg deflections sixty times greater than the 10% elongation needed to shear a ligament made of Aluminum 7075-T6. The only desired operation of the joint is total ligament shear while plastic leg flex is an unnecessary waste of combustion energy in the prior art designs. Calculations also show that only 1% of the combustible load energy in a typical frangible joint is necessary to fracture both ligaments. The other 99% of the energy is spent on non-essential work. While some leveling effects do occur because the XTA is cradled in the expansion cavity, a large quantity of the combustion energy is lost to bending the already fractured side instead of contributing to fracturing the ligament on the unfractured side. Since the theoretical work required to accomplish complete ligament fracturing is approximately 0.2 grains of HNS per foot, and in typical prior art the combustible load is 24 grains of HNS per foot, this indicates that only 1% of the combustion energy is applied to complete total ligament fracturing while most of the combustion energy is diverted to perform non-essential work on other parts of the joint in the form of unnecessary travel.

In three dimensions shown in FIG. 2F, the second ligament will never fracture. The XTA is a pipe so the two dimensional effects delineated above apply in 3 dimensions as well as with any combination of ligaments. Therefore, if complete disassociation occurs before complete crack propagation on all other ligaments, complete separation becomes unlikely. Even with high explosives, a completely disassociated ligament section provides an easier path for energy flow rather than to the completion of all ligament fracture. Prior art illustrations do not indicate joint function in three dimensions and never show interactions between XTA sections down the length of a frangible joint. If the teachings of prior art are combined, it can be seen that frangible joint functioning in stepwise events over an entire XTA has not been anticipated. This oversimplified philosophy of frangible joint operation has led to designs that have inadequate performance concerning reliability.

Therefore it becomes apparent that the mechanism by which the ligament fractures occur in prior art is not reliable when viewed as a hydraulic process. The removal of timing constraints on ligament fracture opens up many possibilities in designs as well as testing to discover the underlying mechanisms of ligament fracturing. Also, testing costs are greatly reduced when joint fracture is studied by slow hydraulic actuation. If an XTA within an assembled prior art frangible joint is slowly pumped by hydraulics, the ligament fracture mechanism can be witnessed in slow motion and it demonstrates that simultaneous ligament fracturing almost never occurs. Slow pressure rises highlight design flaws by demonstrating that creep reduces reliability margins.

SUMMARY OF THE INVENTION

The present invention does not rely on the highly dynamic emphasis of prior art and instead utilizes a static mechanical solution that uses combustion energy much more efficiently by implementing an energy efficient physics-based automatic compensation method. This method allows the complete fracture of all ligaments in three dimensions without dependence on shattering effect or shock wave interactions from high explosives. A major operational goal of the present invention has been to produce a robust design that is insensitive to uncontrollable factors. The main effort has been in the area of energy conservation. A device which shears all ligaments with less energy can overwhelm interference caused by external noise factors such as wind loads, temperature gradients, corrosion, or shock wave interactions. Intrinsic noise factors such as aging and product related factors such as supplier crystal grain orientation or material extrusion thickness can be overcome with an extremely efficient frangible joint. Geometric changes to an XTA can smooth the actuation of a frangible joint. Chisel like elements can focus energy at a very narrow location which maximizes energy application to ligament shear with minimal leg bending. Limiting leg travel after fracture can allow for the application of conserved energy to the fracture of all locations. The combination of all three methods results in a robust design that can easily compensate for all uncontrollable factors.

Recent research by I. Alcantara demonstrates that Aluminum 7075-T6 in a frangible joint geometry has fracture toughness that is mostly independent of stress rate. In other words, the time it takes to fracture the ligament has very little to do with how quickly stress is applied. This independence from stress rate enables the present invention designs to operate sequentially, and therefore time of XTA inflation is not a critical design criterion as with prior art. With inflation time removed from the list of necessary conditions for complete separation to occur, any method of producing pressure within an XTA can be employed. Although descriptions concerning the functioning of the present invention describe the use of slow hydraulic pressurization as a means to actuate the frangible joint, the present invention can also utilize fast explosive methods to inflate the XTA, and could benefit from shock wave interactions and shattering effects. The system will operate well with high explosives such as HNS, HMX, or PETN or low explosives such as smokeless powder as the combustible load. Gas producing reactions such as burning Titanium Hydride Potassium Perchlorate (THPP) or Sodium Azide will also work well. Even slow hydraulic pumping can function the joint with the same sequence in slow-motion. Any of the gas producing reaction methods can be localized as a cartridge or inflator at the end of an XTA, partially distributed along the length of a frangible joint section, or totally distributed down the length of an XTA as in the case with an MDC.

A version of the present invention is shown in the radial plane slice sequences of FIG. 3A through FIG. 3F, and illustrates the physics-based automatic compensation method that makes the present invention so reliable. This configuration of the present invention, represented in FIG. 3A, contains a clevis assembly consisting of a clevis, two frangible portions, and two stop plates that are all bolted together. This clevis assembly is also bolted to a tang, through the lower parts of the frangible portions. Between the two frangible portions and the clevis and tang plates an expansion cavity is formed, wherein a horizontal recurved XTA and two shear plate assemblies are placed.

For the purposes of this sequence, the XTA contains one combustible load, is recurved to accommodate the shear plate assemblies, and is positioned to apply force against the shear plate assemblies. The shear plate assemblies start in an angled position, with the pivot point between them nestled in the recurved section of the XTA, with each of their tips positioned close to the desired fracture plane. The most important feature of the present invention is the stop plates. These stop plates lap all of the ligament areas and are thick enough to restrict post fracture leg movements.

When the combustible load fires, pressure within the XTA causes the XTA to gradually reform back into a round shape, causing force to be applied to the shear plate assemblies. This force is vectored by the shear plate assemblies to the optimal location for ligament shearing, causing one of the ligaments to shear first. Once this first ligament has completely sheared, the stop plate on that side restricts movement of that leg so that the remainder of the shear forces can be applied to the other unfractured ligament, as seen in FIG. 3B.

The essential function of stop plates in the present invention is energy conservation. By limiting unnecessary leg travel, they channel combustion energy from the combustible load to ligament fracture across an entire frangible joint. By comparing FIGS. 3C and 3D, it can be seen that after fracture of both ligaments are complete the legs bend for a small marginal distance until their movement is progressively arrested by stop plates. This gradual breaking action is analogous to the dragging of a fractured ligament described in the prior art. However, this breaking action is enduring and therefore provides a more effective and predictable work leveling action compared to prior art. If unnecessary travel can be prevented, then combustion energy can be conserved to accomplish the complete fracturing of all ligaments. The superior work leveling action of the present invention prevents wasteful flow of energy into non-productive leg bending in three dimensions as well.

Since the XTA of FIG. 3A started as a seamless tube and is inflated back to the original circular cross-section, pressure built in one zone of the XTA will very quickly equalize down the entire length of the XTA section. From the two-dimensional perspective of prior art, only a single internal central stop could ensure that fracturing is complete. However, since pressure within the XTA can communicate along the length of the frangible joint, and fracture sequence is random, independent mechanical stops for all fracture locations are necessary until all of the ligaments are fully fractured. Each three dimensional section of a frangible joint should be treated as a whole, and the total combustion energy minus losses must exceed the energy required for shearing of all ligaments in that section. Since there are no compartments for available work and if easier paths for energy flow are provided after fracture, methods of rationing that work to just above what is needed for all ligaments to fracture must be a part of the design for guaranteed separation of the entire joint.

With the outward bending motion of the legs stopped by plates as shown in FIG. 3C, force exerted by the XTA on the shear plate assemblies again increases as plotted in FIG. 4. The difference between the peak force required to fracture the strongest ligament portion anywhere in the entire separation assembly and the force to push the three-dimensional shear plate assemblies completely flat is extremely important. Reliability of complete separation of an assembly is highly dependent on the margin between these force levels. If these force levels match or invert, total separation is not guaranteed. Therefore, the peak shown in FIG. 4 that corresponds to the state of the joint shown in FIG. 3D must exceed the force peak at fracture for all ligaments down the length of a separation assembly.

With travel limited in fractured regions, energy is conserved to then be applied to unfractured regions either across or down the length of the joint. Since the XTA is generally a pipe, when gas pressure develops at a point where both inner and outer ligaments are fractured, the excess gas is allowed to communicate down the XTA and apply work to any non-fractured ligaments within the whole frangible assembly. The combination of gas commutation down the XTA and stops of many possible forms makes this large increase in energy conservation possible. Stops of various designs can be employed to confine the total travel of a fractured section to between one tenth to sixty times the elongation limit of the fracture plane material. This prevents the effect of non-productive energy flow shown in FIG. 2F. Blocking the flow of combustion energy through an easier path at a fracture ensures that energy deposition is roughly leveled across the length of an entire joint. All of this energy conservation helps to create the wider operational window shown in FIG. 5 which is many times greater than the minimum required by the fracture plane material. That margin can be used to easily compensate for wide geometric, environmental, and material property variations. This efficiency lowers the amount of energy required to completely fracture an entire frangible joint far below that of prior art while increasing reliability. This is accomplished by widening the margin between the energy brackets of the apparent joint strength and the XTA strength. An example of stop plates required at one tenth of the elongation length of the fracture plane material would apply to designs that employ slack fasteners. Stop plates located at sixty times the elongation length of the fracture plane material may be required to prevent XTA rupture.

The reliability of this type of joint can be tested by slow hydraulic pumping of the XTA which is the least expensive functional test possible for distributed inflation. XTA inflation by slow pressurization from one end may be more preferable for some assemblies than the distributed pressurization provide by an MDC, but care must be taken to ensure that the inflation rate is slow enough so as not to overwhelm the stop plate leveling effect and render a joint unreliable.

Shear plate assemblies are additional combustion energy conservation devices of the present invention. Shear plate assemblies accomplish this in the present invention by focusing force to the optimal leg location for the most efficient ligament shear while limiting energy spent on non-essential leg motion. In the present invention, the XTA is oriented so that once actuated it will expand parallel to the legs and apply its force upon the pivot point between the shear plate assemblies, as seen in FIG. 3B. This XTA expansion orientation is orthogonal to that of prior art. The shear plate assemblies focus and divert force from the XTA perpendicular to the legs. Narrow edges of these shear plate assemblies localize the application of energy to the optimal leg location. These plates use the majority of the combustion energy delivered by the recurved side of XTA and vector it progressively perpendicular to the ligaments to effect shear. While a small portion of the energy developed by the combustible load is re-directed by the shear plate assemblies and is applied to flexing of the legs, the majority is applied to optimized ligament shear. These plates apply twenty times more shearing energy compared to prior art. These shear plate assemblies must touch together at the pivot point in order to apply shearing perpendicular to the legs. Without this touching, shear plate assemblies that are integrally formed with the frangible portions will apply only torque around the ligaments. This torque is very ineffective at creating ligament fracture in prior art compared to pure shear across the ligament as is the case in the present invention.

Illustrated in FIG. 3C we can see that as the angle between the shear plate assemblies approaches 180 degrees, the mechanical advantage created by the geometry allows available shear force to increase while the force from the XTA remains level. At this point, most of the work is applied to the unfractured ligament. At the same time, the pivot point between the shear plate assemblies moves back to the original central location. Once the pivot point between the shear plate assemblies has been pressed to approximately one half of the distance to flat, as seen in FIG. 3C, misalignment and therefore binding are nearly impossible. Also, since the angle of the shear plate assemblies are nearly flat at this point, very little additional pressure is needed to complete ligament fracturing. Since it is important that force is applied mainly to the apex formed by the shear plate assemblies through the first half of shear plate pressing, a flat or convex XTA would permit expansion around the apex, and this could create side thrust that could bind the assembly. The recurved shape of the XTA maintains balanced expansion on both sides of the apex which prevents binding in the first half of travel.

The major axis of XTAs in prior art are always parallel to the legs, as seen in FIG. 2A, and the shape is usually a racetrack formed by the pressing of a tube between two parallel surfaces. An alternative option in the present invention rotates the major axis so that it is perpendicular to the legs, as seen in FIG. 3A. The bottom and the majority of the sides maintain an original tubular shape while the uppermost part of the sides have a recurved surface pointing toward the center of the original tube. As seen in FIG. 3B when the device is activated and pressure builds in the XTA, the recurved surface inflates back toward a circular geometry. Even if this tube is formed with a recurved profile, the tube will migrate to a circular cross-section when internal pressure is applied. In this alternative orientation, as the XTA continues to inflate, very little force is directly applied to the legs, and instead most of the available force is applied to the shear plate assemblies. The cradle shaped tang surface further reduces wasted work by preventing reshaping of the XTA base. With combustion energy being used much more efficiently by the XTA and the shear plate assemblies, only about 10% of the energy goes into reversible and irreversible energy before shear occurs.

The present invention offers the possibility of integrated thrust separation. The use of a rotated XTA allows for an adjustable thrust separation force to be applied as the last step of the joint separation sequence. Careful selection of the XTA diameter and the distance between the central clevis plate and the central tang plate will determine the amount of work applied to thrust separation. Even in cases where all ligaments are not fractured, thrust can assist in the completion of total separation through tearing action. This assisted tearing action is not possible in prior art because of the major axis orientation of the XTA. Thrust separation is also assisted by the return of energy from clastic work from the legs and stop plates, provided that the shear plate assembly has pivoted over 180 degrees, as seen in FIG. 3D through FIG. 3F.

The most essential behavior of the preferred embodiment is summarized in FIG. 4. This graph show the force applied to the shear plate assemblies by the XTA, over the sequence of time shown in FIG. 3A through FIG. 3F. This functioning is distinct from all prior art. At a time just prior to combustion initiation as shown in FIG. 3A, the force exerted by the recurved XTA upon the shear plate assemblies is zero. Following initiation, combustion of the combustible load creates pressure on the inner walls of the XTA. This pressure acting through the XTA creates a force which is mainly between the tang and the shear plate assemblies. Very little force is exerted outwardly on legs of the frangible portions. Pressure builds inside the XTA as well as force on the shear plate assemblies until ligament 1 fractures as shown in FIG. 3B. Since the load of shearing ligament 1 has been eliminated, the force delivered by the XTA is temporarily reduced. This is shown in FIG. 4 just past ligament 1 fracture. Once the leg is bent to the point where it touches the stop, force from the XTA on the shear plate assemblies again increases until ligament 2 fractures. Since ligament 2 fractures at a local maximum shown in FIG. 4, the force exerted by the XTA again decreases as the leg bends outward until it contacts the stop plate on that side.

With the outward bending motion of legs stopped by the stop plates as shown in FIG. 3C, force exerted by XTA on the shear plate assemblies again increases as plotted in FIG. 4. The difference between the peak force required to fracture the strongest ligament portion anywhere in the entire separation assembly and the force to push the three-dimensional shear plate assembly completely flat is extremely important. Reliability of complete separation of an assembly is highly dependent on the margin between these force levels. If these force levels match or invert, total separation is not guaranteed. Therefore, the peak shown in FIG. 4 that corresponds to the state of the joint shown in FIG. 3D must exceed the force peak at fracture for all ligaments down the length of a separation assembly. In other words, as long as the sequence of all ligament fracturing occurs before the thrust separation event, then complete separation of the frangible joint is ensured. This must also include a margin for all manufacturing and environmental conditions. In some cases that margin may depend on gas production location and other XTA restrictions. Distributed gas generation can easily reduce those design restrictions, whereas localized gas generation requires more consideration. The energy delivery profile to the inflation device can be matched to design requirements such as slack removal, high shearing stress prior to fracture, or decelerated pressurization between all ligament fracture of the assembly and the start of thrust separation.

Timing of thrust separation and the amount of force provided for separation can also be regulated by the clevis side shape of the expansion cavity. A concave surface can provide a delay in separation and or a lessening of thrust, while a convex shape can provide an acceleration of timing events and can provide a stronger thrusting separation. Performance of the thrust separation feature of the present invention is highly dependent upon design requirements, therefore any configuration between convex, concave, and tang to clevis distance is anticipated.

Since it has been proven that ligament fracturing is nearly independent of time, other pressure making methods and reactions are now able to be considered. The choice of pressure generators in the XTA can also help with energy conservation. Materials that deflagrate may be a better alternative to the development of pressure in an XTA than high explosives. During deflagration, the combustive material burns evenly and at a uniform rate on all ignited surfaces. Additionally, gases and other combustion byproducts flow away from the burning surfaces. This gradual pressure development within an XTA appears to be a better match for a mechanical process that gradually applies force to shear a ligament. For example, THPP is used on pyrovalves as a booster which provides pressure to activate a piston. HNS would be a poor choice for this application because the high brisance is counter to the design requirements. Since an XTA also behaves similar to a piston, THPP can be considered as a replacement for HNS in frangible joints if there are no properties such as excessive sensitivity to impact, temperature, or static electricity that would preclude the use of THPP. Even low explosives such as gunpowder can be considered. Matching the pressure development curve with the stress-strain curve of the ligament structure should create the greatest reliability. Another example would be Sodium Azide, which is used worldwide to inflate automobile airbags. These other methods may have advantages over high explosives because of wider temperature ranges, lower sensitivity to shock or static electricity, improved stability, or more efficient pressure development matches. Slow pressurization is the worst-case scenario and if the joint operates reliably under these conditions, it will certainly operate reliably at faster pressurization rates.

FIG. 5 shows the improvements provided by the present invention over prior art and are illustrated by re-plotting the bounding conditions of FIG. 1. Of course, the structural strength curve remains the same since that is dictated by launch stresses. Also, the theoretical strength remains the same since this is dictated by the launch stresses plus a reasonable safety margin. Assuming that the XTA material and geometry before shaping remains the same, the XTA rupture strength curve will also remain mostly the same. A difference appears in the location of the apparent strength curve. While theoretically the energy of one hundred combustible loads could be contained by the same XTA, some inefficiencies cannot be avoided which will not allow 100% of available combustion energy to be applied to joint fracture. Losses such as XTA reforming, XTA drag on the legs and the shear plate assemblies, drag on the lower tang, radiation losses to the XTA and a charge holder, clastic and plastic deformation of components all combine to increase the apparent strength of the frangible joint. As a result the apparent strength curve in FIG. 5 has dropped to 7 gr/ft from the 24 gr/ft as seen in FIG. 1. This new apparent strength is derived from the theoretical strength plus all the unavoidable inefficiencies inherent in the design of the present invention. Since the present invention is so much more efficient then prior art, the apparent strength is much lower. Therefore, the operational window shown in FIG. 5 is now much wider as compared to the operational window in FIG. 1. This lower apparent strength allows for the possibility of a lower minimum combustible load required to function a joint. Also, manufacturing tolerances can be loosened because there is room on the X axis for the trailing edges of curves to intersect less and not compromise the 99.95% reliability requirement. This also allows for failure-to-fracture regions to be less than 0.05% which means that 99.95% reliability is possible.

With all these increases in margin between the apparent strength and XTA strength, multiple combustible loads can now be placed within the XTA without compromising the 99.95% reliability through the trailing edge overlap, as seen in FIG. 5. Each combustible load can contain enough combustion energy to fracture the frangible joint completely, and with the combined energy of all of the combustible loads still falling below the upper limit of the XTA strength, all of the combustible loads can confidently be fired at the same time and still not rupture the XTA. Even though the firing of all combustible loads is now possible, it may be more desirable to reduce the load count to two in an attempt to lessen the shock to the structural frame. Although multiple combustible loads could all be fired at once with no timing skew, separation sensors could control combustible load sequencing until total joint separation is complete. This sensing of separation and controlling of the combustible load sequencing not only ensures the complete fracturing of the assembly but also provides a means of ensuring that no excess shock is delivered to the structure. In the case of prior art, waste of mechanical energy prevents the grouping of multiple combustible chains because simultaneous activation of multiple combustible loads would cause XTA rupture. With the present invention, even unintentional sympathetic activation of all three combustible loads will not rupture the XTA. Also with the level of redundancy provided by the present invention, a combustible chain can have many failures to fire, while only requiring one of the combustible loads for a joint to function properly. Since this operational window of the present invention has been expanded by the efficient application of combustion energy to the primary task of complete ligament fracturing, the present invention allows for multi-fault-tolerance. Due to this multi-level redundancy, the present invention can even exceed the requirements for two-fault-tolerant systems, and therefore meet the requirements published by NASA for Human Space Flight.

BRIEF DESCRIPTION OF THE SEVERAL VIEWS OF THE DRAWINGS

The various embodiments of the present invention, as well as representations of prior art can be understood with reference to the following drawings. The components are not necessarily to scale. Also, in the drawings, like reference numerals designate corresponding parts throughout the several views.

DETAIL DESCRIPTION OF THE INVENTION

Figure 1:
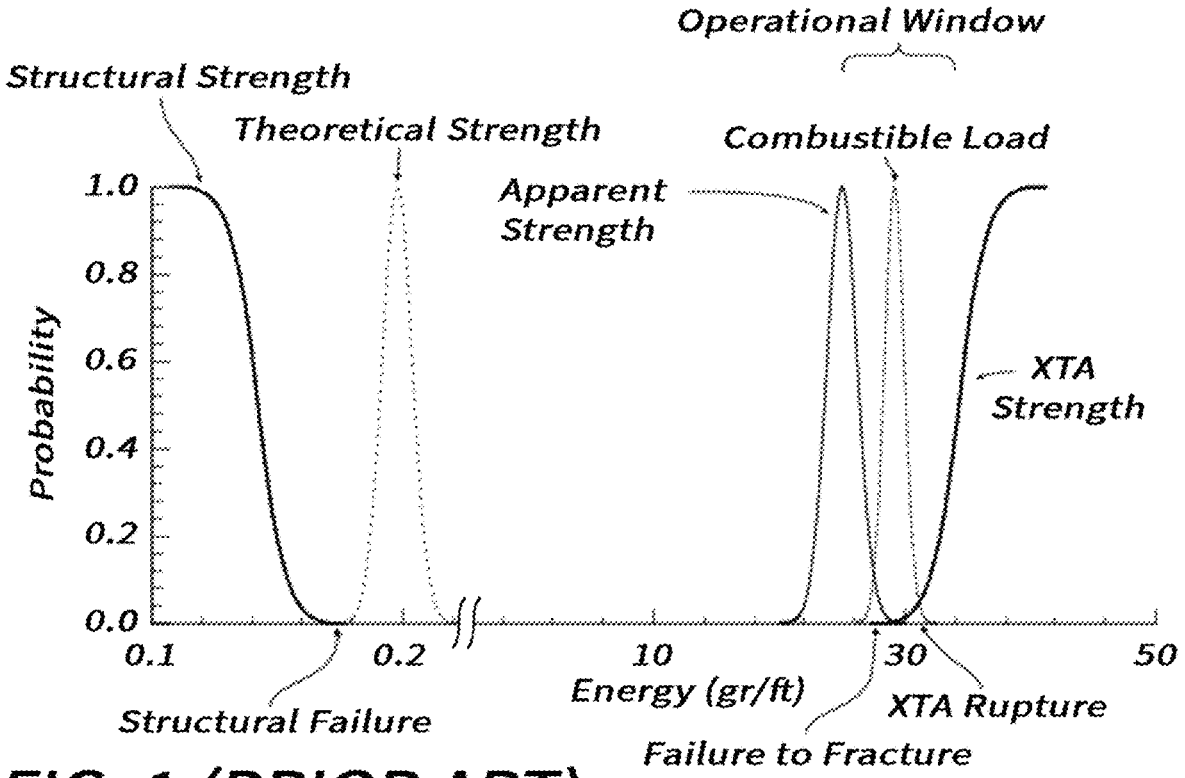
FIG. 1 (PRIOR ART)
FIG. 1 is a reliability diagram of prior art.

The present invention is more particularly described in the following description and examples are intended to be illustrative only since numerous modifications and variations therein will be apparent to those skilled in the art. As used in the specification and in the claims, the singular form "a" "an" and "the" may include plural referents unless the context clearly dictates otherwise. A directional term such as "upper", "lower", "right" and "left" may not to be limited to the precise orientation specified, but instead such directional terms should be understood to only denote orientations relative to a drawing. Furthermore, the orientation terms of "horizontal" and "vertical" are in relation to a normal mounting configuration, in which the vertical axis is in line with the structures to be held together, and the horizontal axis is generally the plane in which separation occurs. Also, as used in the specification and in the claims, the term "comprising" may include the embodiments "consisting of" and "consisting essentially of". Furthermore, all ranges disclosed herein are inclusive of the endpoints and are independently combinable. Also, as used in the claims the term "bonded" is defined as an object joined securely to another object by a bonding means which include but is not limited to an adhesive, a heat process, pressure, or ultrasonic acoustic vibration methods, such as ultrasonic welding.

As used herein, approximating language may be applied to modify any quantitative representation that may vary without resulting in a change in the basic function to which it is related. Accordingly, a value modified by a term or terms, such as "about" and "substantially" may not to be limited to the precise value specified, in some cases. In at least some instances, the approximating language may correspond to the precision of an instrument for measuring the value.

As shown and described herein, various features of the disclosure will be presented. Various embodiments may have the same or similar features and thus the same or similar features may be labeled with the same reference numeral but preceded by a different first number indicating the figure to which the feature is shown. Although similar reference numbers may be used in a generic sense, various embodiments will be described and various features may include changes, alterations, modifications, etc. as will be appreciated by those skilled in the art, whether explicitly described or otherwise would be appreciated by those skilled in the art.

Figure 2A:
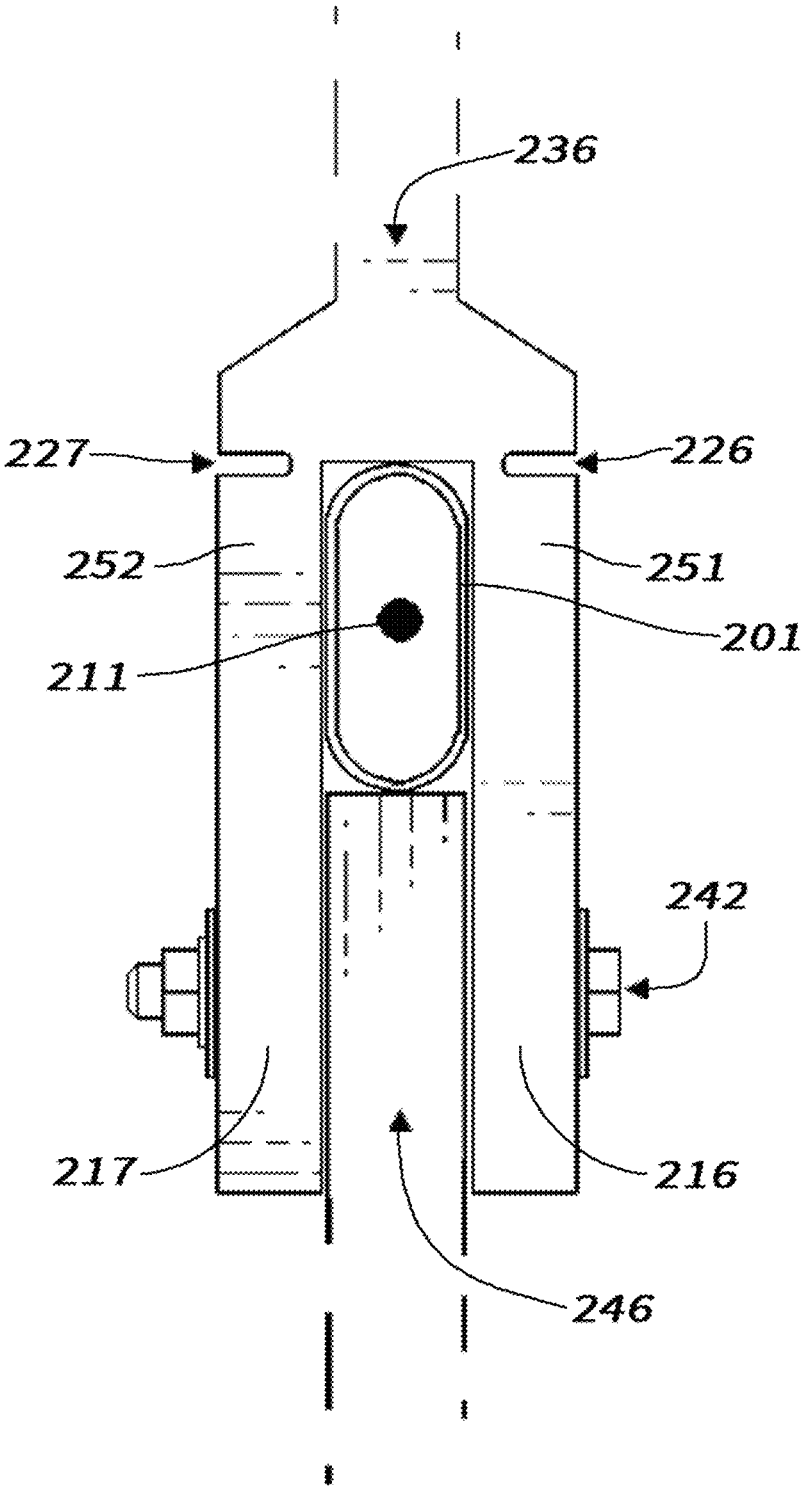
FIG. 2A (PRIOR ART)
FIG. 2A is a partial cross-sectional view of an example prior art frangible joint assembly before the frangible joint had been activated.

The reliability deficiencies of prior art designs are explained by the illustrated sequence of FIG. 2A through FIG. 2F. FIG. 2A illustrates a partial cross-sectioned view of the pre-activated state of a typical frangible joint, with an upper clevis 236 made integrally with the two frangible portions 216 and 217. Both frangible portions have a groove in each of them that creates a thinned section known of as ligaments 226 and 227, which act as stress risers for the desired fracture planes. The upper clevis 236 is bolted 242 through the frangible portions 216 and 217 to a lower tang 246. An expansion cavity is formed between the frangible portions 216 and 217, the upper clevis 236 and the lower tang 246, wherein an XTA 201 is placed. This XTA 201 is compressed into a racetrack shaped so that upon inflation it will reshape itself in a horizontal fashion, applying its force to the frangible portions legs 251 and 252. The XTA also contains a single combustible load 211, which is typically HNS high explosive.

Figure 2B:
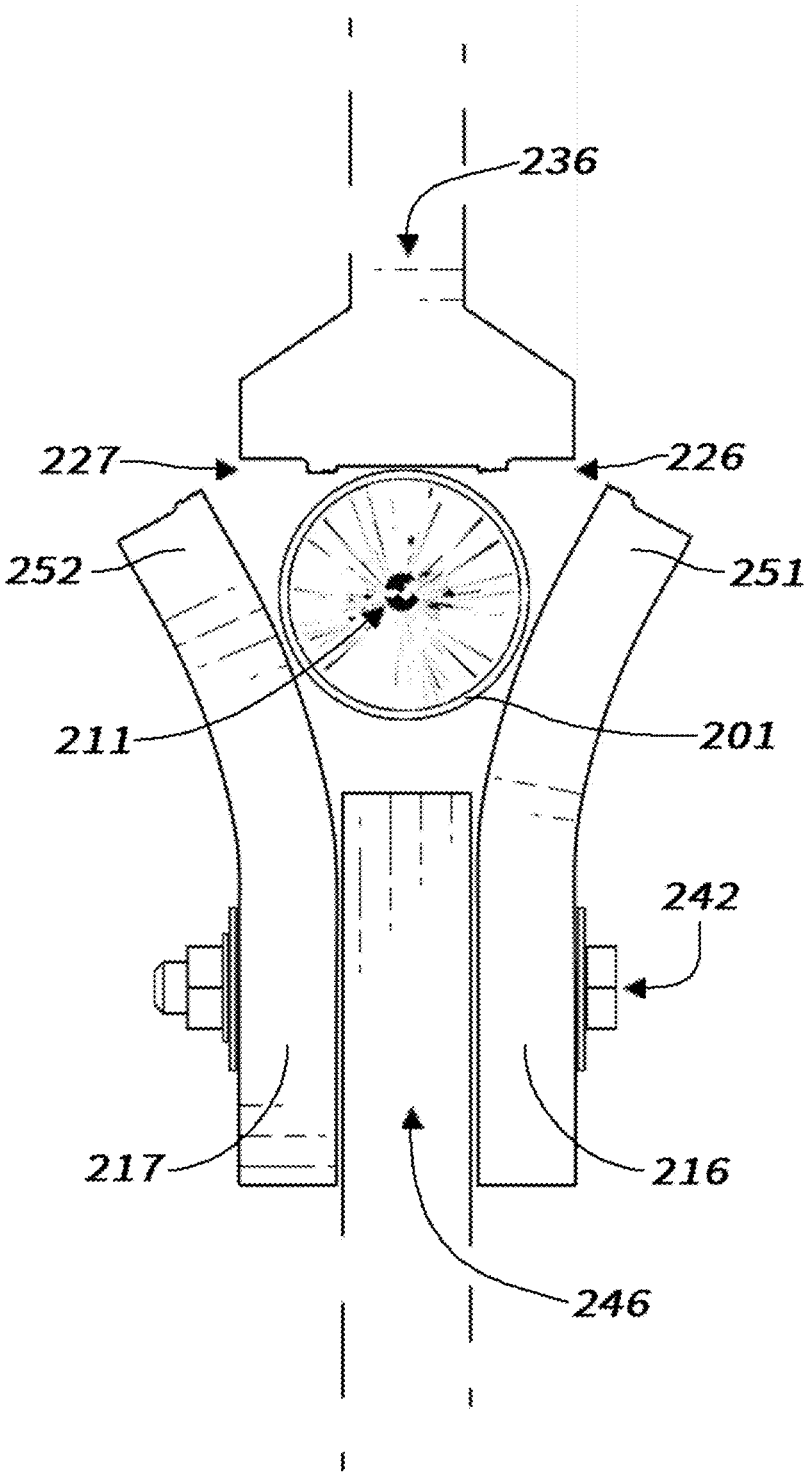
FIG. 2B (PRIOR ART)
FIG. 2B is a view similar to that of FIG. 2A where the frangible joint has been explosively activated and shows prior art assumption of symmetric functionality.

FIG. 2B illustrates a perfectly separated frangible joint. This shows a typical embodiment of prior art in which the combustible load 211, has detonated, and filled the XTA 201 with combustion byproducts and thereby increased the pressure inside the XTA 201. The XTA 201 has rounded due to the increased internal pressure and has applied force outwardly against the frangible portions 216 and 217, which, due to the force, have fractured along their respective fracture planes. The now untethered lower parts of the frangible portions, referred to in the art as legs 251 and 252, have bent outwardly under the continued force exerted on them by the XTA 201. In this illustration it is shown how prior art perceives this outward bending of the legs 251 and 252 to happen in a symmetric fashion.

Figure 2C:
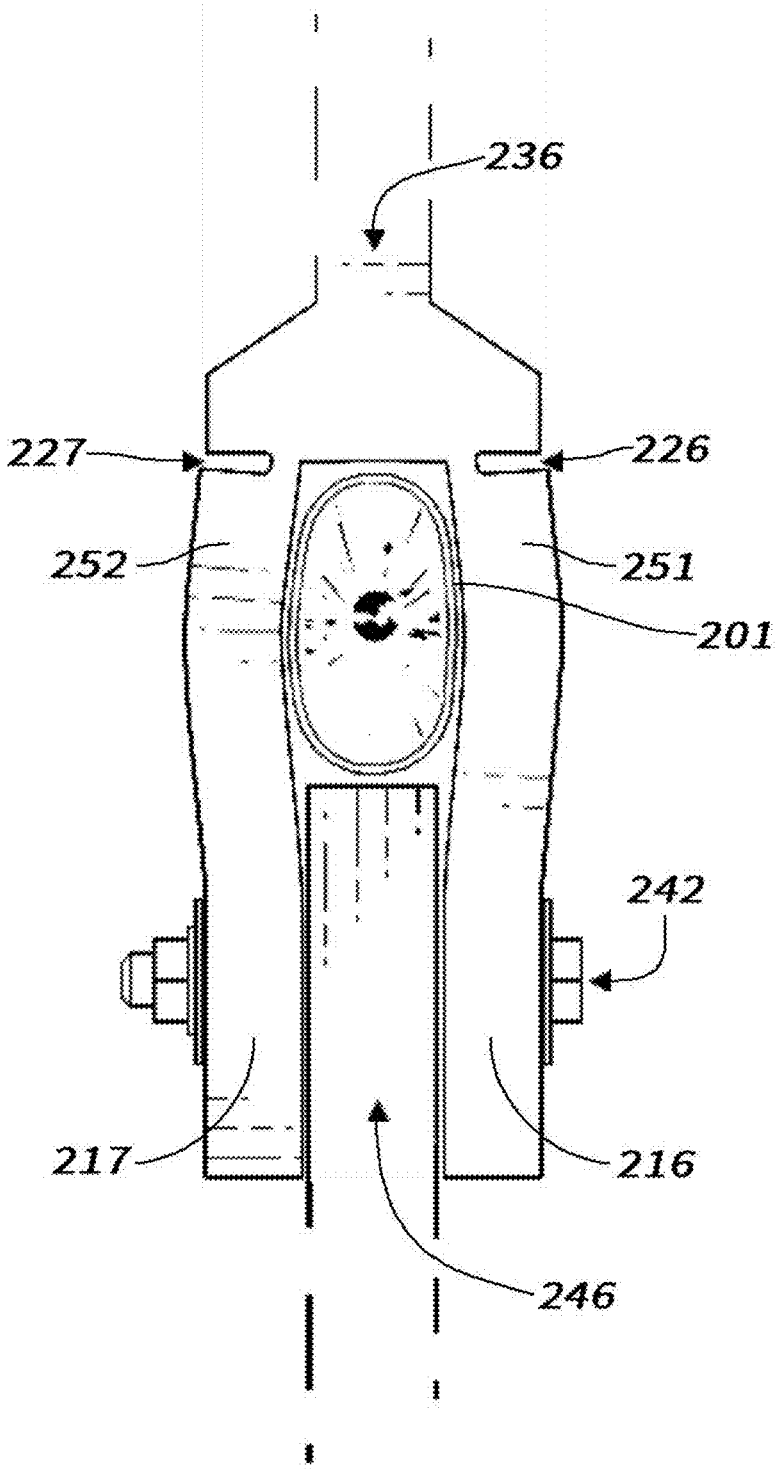
FIG. 2C (PRIOR ART)
FIG. 2C is a view similar to that of FIG. 2A where the frangible joint has been explosively activated and the XTA is beginning to inflate and is applying force to both of the legs.
Figure 2D:
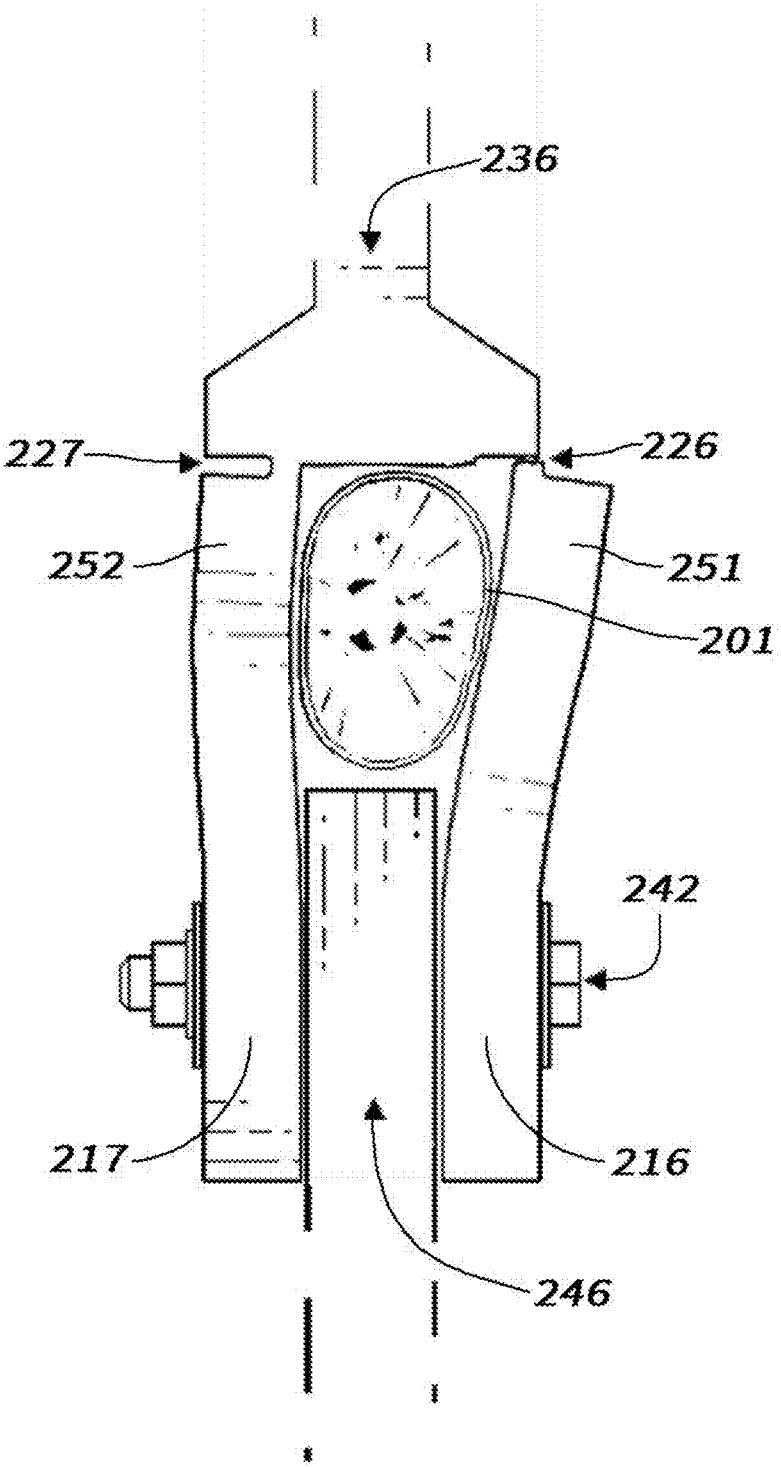
FIG. 2D (PRIOR ART)
FIG. 2D is a view similar to that of FIG. 2C where a ligament has fractured on the right side and the XTA has begun to inflate more easily toward the right side.
Figure 2E:
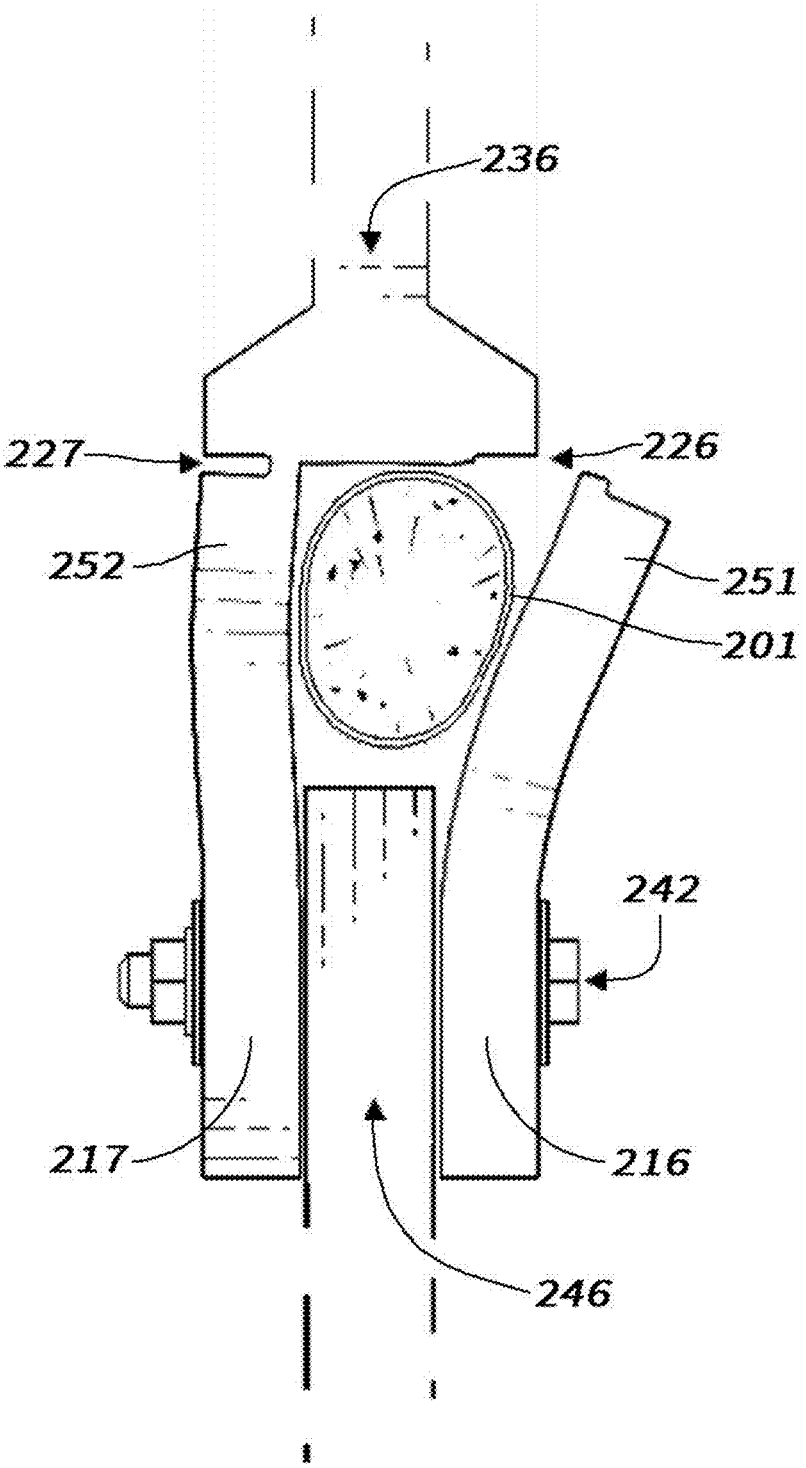
FIG. 2E (PRIOR ART)
FIG. 2E is a view similar to that of FIG. 2D where the leg on the right side is bent out even further, and with the energy of the XTA almost exhausted, has allowed the ligament on the left side to remain unbroken.

FIG. 2C through FIG. 2E illustrates the sequence of a prior art frangible joint that has failed to separate. FIG. 2C shows the state of the frangible joint just after FIG. 2A in which the combustible load 211, has been ignited, and is pressurizing the XTA 201 with combustion byproducts. The XTA 201 has begun to round due to the increased internal pressure and is now applying force outwardly against the legs 251 and 252, causing them to bulge. At this point the force exerted on the legs 251 and 252 is relatively equal, and therefore both ligaments 226 and 227 have a chance of fracturing.

As seen in FIG. 2D. the right hand side ligament 226 has broken first, and although the force exerted on both legs 251 and 252 by the XTA 201 is still equal, the resistance of leg 251 is greatly reduced, and the XTA 201 translates in that direction more freely, leaving the leg 252 without enough force to break the ligament 227, before the combustion energy of the combustible load is exhausted, as seen in FIG. 2E.

Figure 2F:
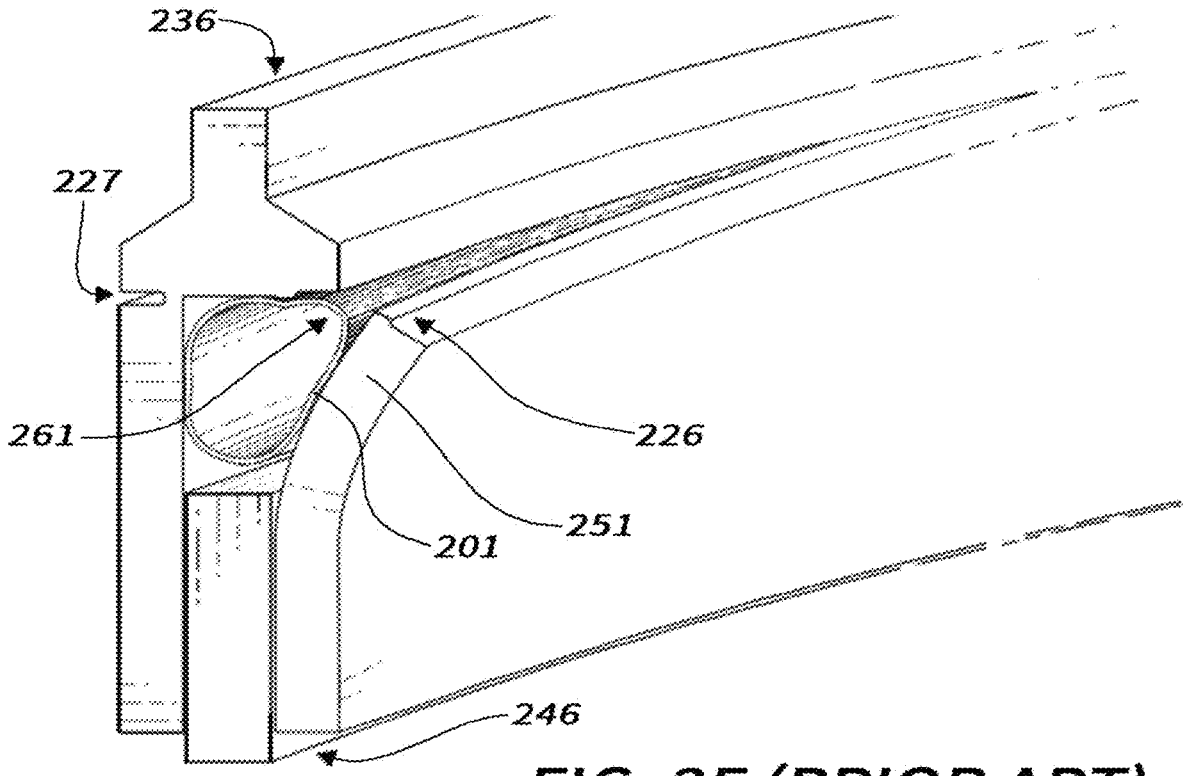
FIG. 2F (PRIOR ART)
FIG. 2F is a partial perspective cross-sectional view of an example prior art frangible joint assembly, showing how an XTA can extrude itself through an already fracture ligament side and therefore waste combustion energy.

Shown in FIG. 2F the leg 251 has been bent open so wide that it allows the now unsupported XTA portion 261 of the XTA 201 to expand outside the expansion cavity, thereby stealing combustion energy from down the length of the frangible joint and further compounding the failure of the assembly.

Most of the following variations of the present invention contain a means of limiting leg travel beyond what is necessary for ligament shear. Some contain shear plates and some contain a recurved XTA. The present invention anticipates any combination necessary to meet launch and separation requirements. The most efficient joints contain all three.

Figure 3A:
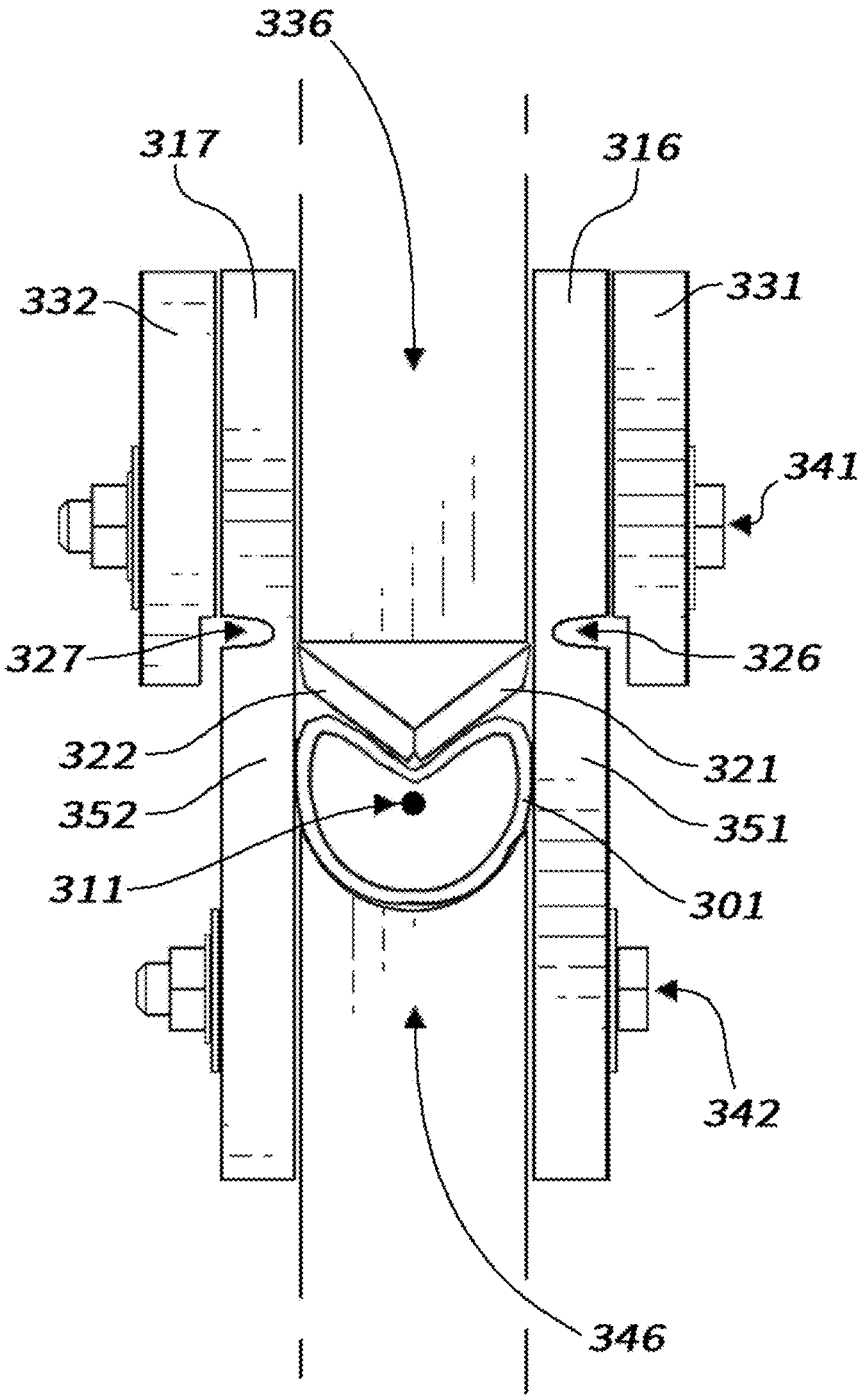
FIG. 3A is a partial cross-sectioned view of one embodiment of the present invention where the attachment portions, frangible portions, and movement stopping elements are all bolted together.

A version of the present invention is shown in FIG. 3A. This illustration shows a partial cross-sectioned view of the frangible joint. The main features are XTA 301 and two frangible portions 316 and 317. Those frangible portions have a thinned ligament feature, 326 right and 327 left. A combined clevis assembly comprised of 316, 317, 331, 332, 336, and 341. A tang 346 is bolted 342 to the clevis assembly through the lower parts of the frangible portions 316 and 317.

The second novel feature shown in FIG. 3A is a set of shear plate assemblies 321 and 322 inserted between the XTA 301 and the clevis assemblies central plate 336. The shear plate assemblies 321 and 322 are attached in a way to form a pivot point. That pivot point is centered in the recurved portion of the XTA 301. The free end of shear plate assemblies 321 and 322 touch legs 351 and 352 on the tang 346 side of ligaments 326 and 327.

Figure 3B:
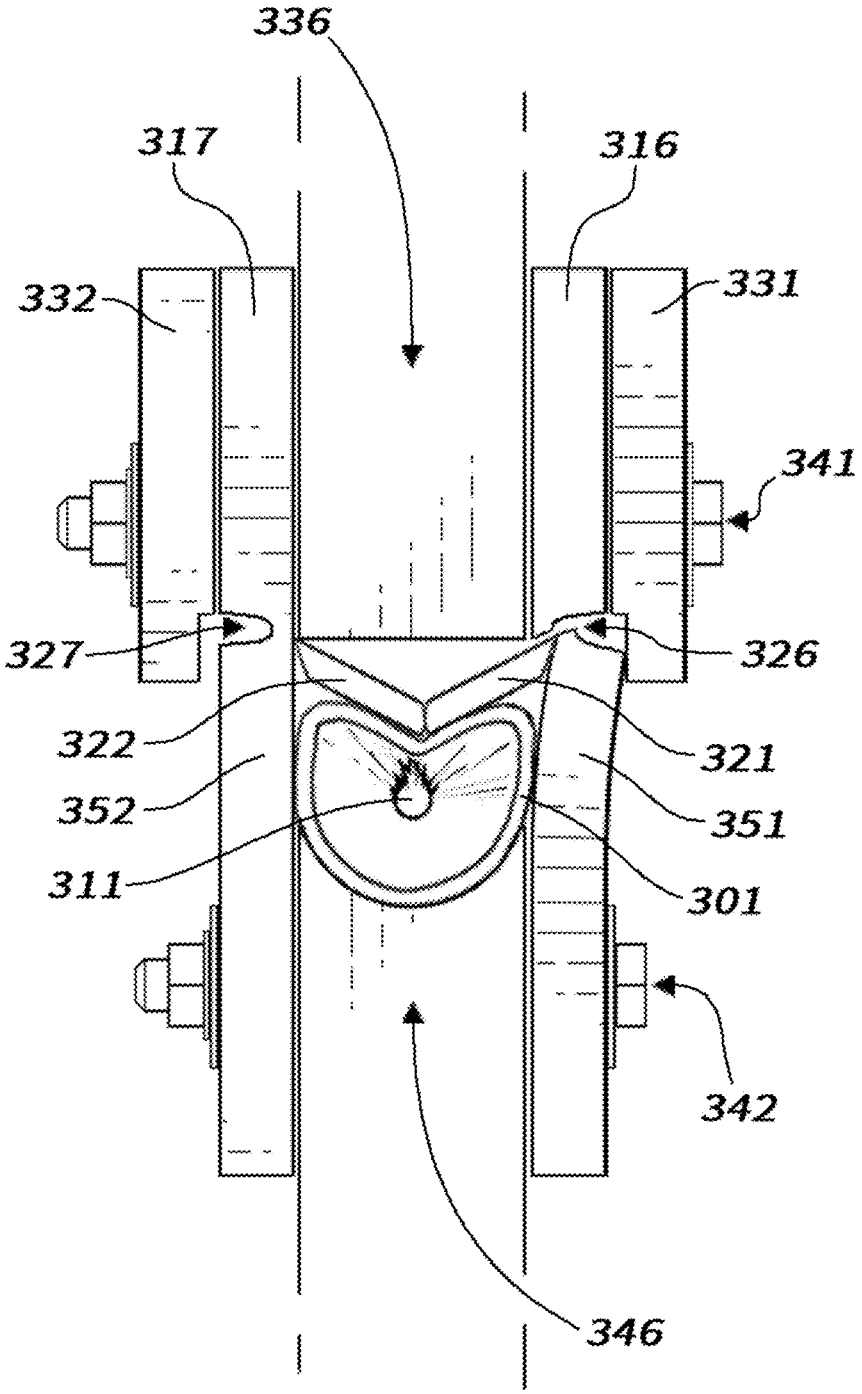
FIG. 3B is a view similar to that of FIG. 3A where the frangible joint has been activated and pressure within the XTA causes fracturing of one of the ligaments.

The most important novel features of the present invention are stop plates 331 and 332 shown in FIG. 3A. Those stop plates 331 and 332 lap ligaments 326 and 327, and are thick enough to restrict the movement of legs 351 and 352 after fracturing has occurred. A gap between the inside of the stop plates 331 and 332 and the outside of the legs 351 and 352 ranges between one tenth and sixty times the maximum material elongation of ligaments 326 and 327. When the combustible load 311 is activated, gases are produced which raise the internal pressure of XTA 301. This pressure gradually inflates and reforms XTA 301 into a circular geometry as seen in FIG. 3B. The rounding of XTA 301 exerts force on the pivot point between the shear plate assemblies 321 and 322 in the direction of clevis assembly central plate 336. This force is vectored by the shear plate assemblies 321 and 322 toward ligaments 326 and 327. One ligament 326 fractures and leg 351 is pushed toward stop plate 331. Gas pressure from the combustible load 311 builds and the XTA 301 continues to inflate and exert force on the pivot point between the shear plate assemblies 321 and 322.

Figure 3C:
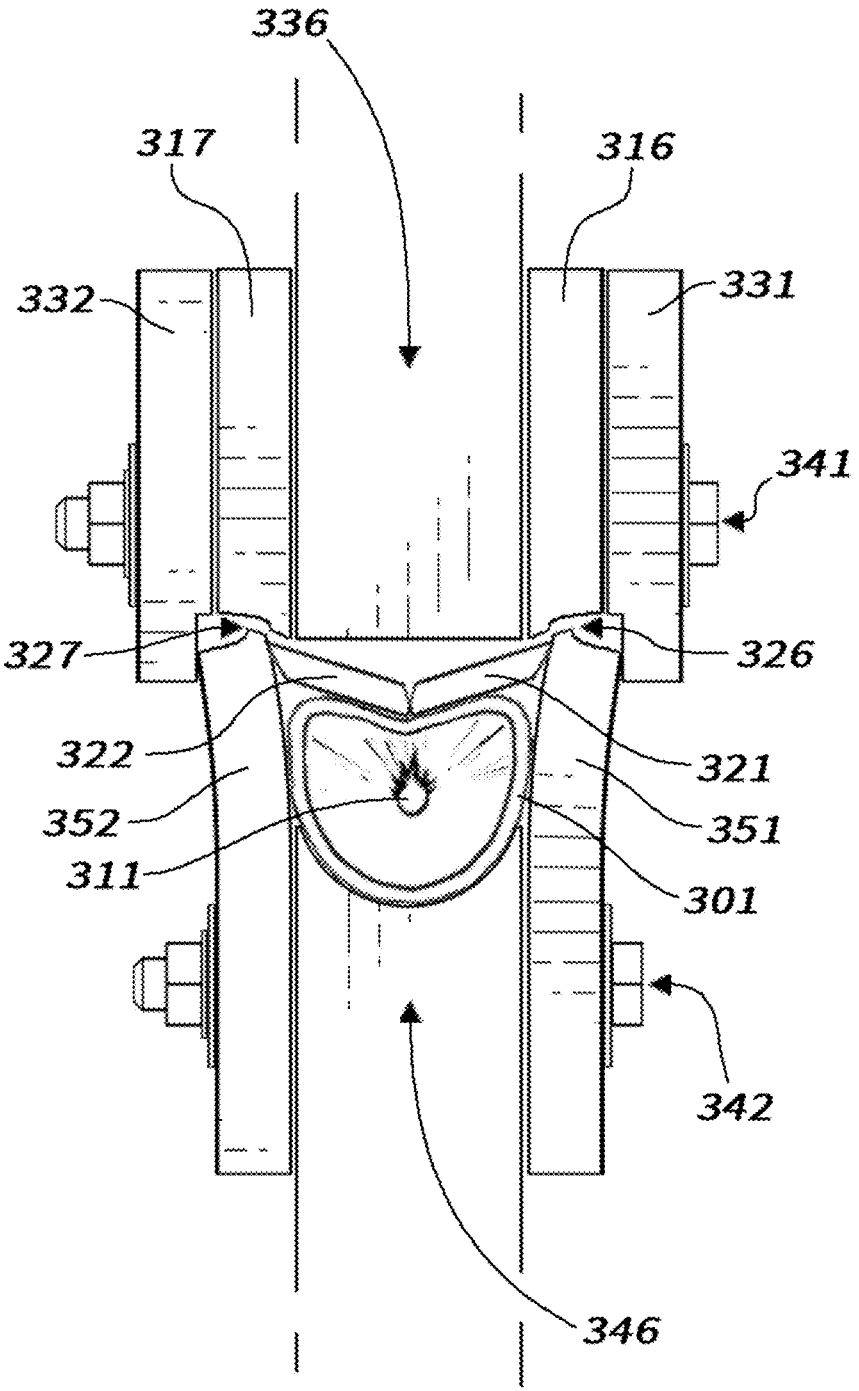
FIG. 3C is a view similar to that of FIG. 3B where ligament fracture has extended to the opposite side of the joint and all ligament fractures in this view are complete.
Figure 3D:
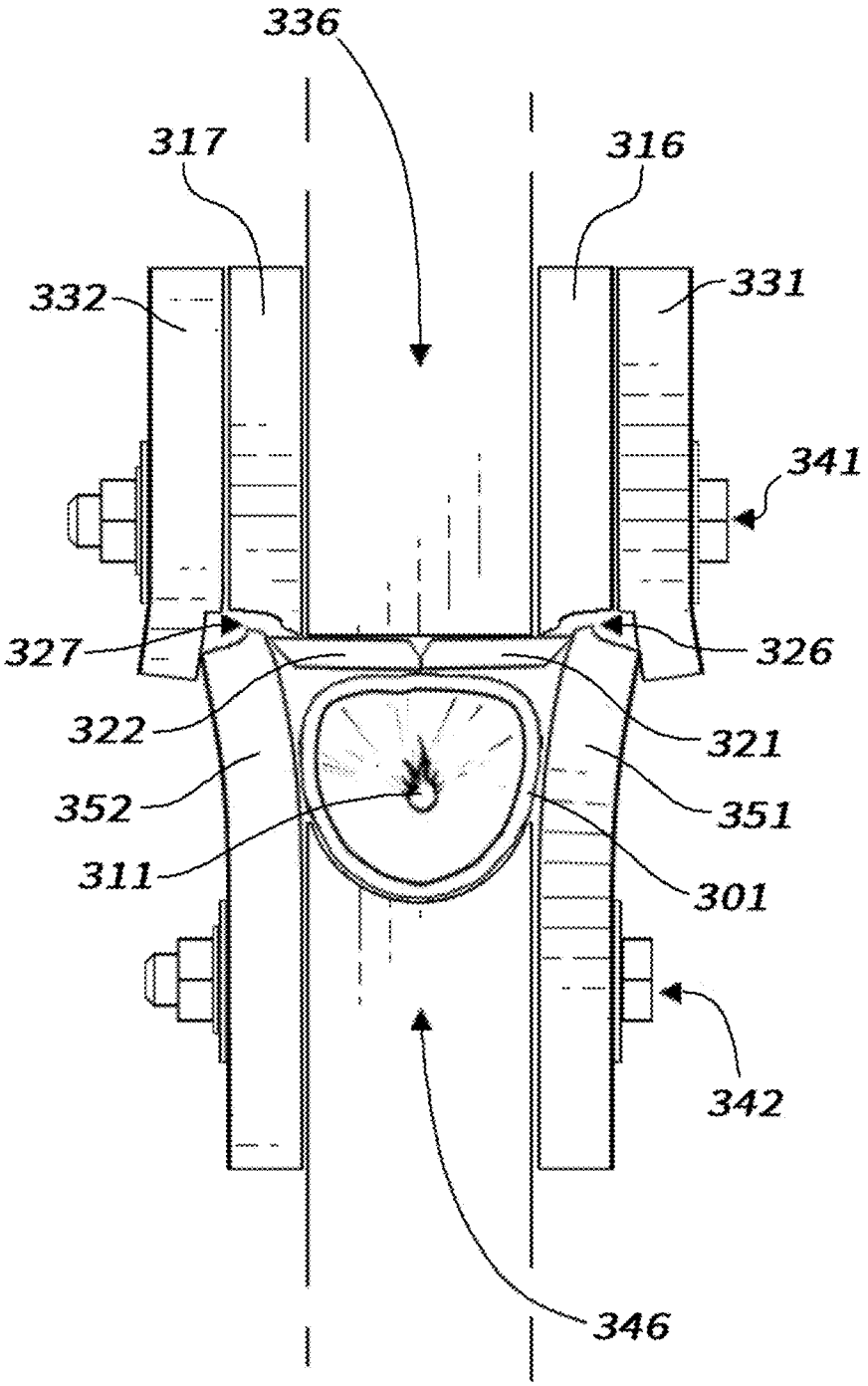
FIG. 3D is a view similar to that of FIG. 3C wherein the shear plate assemblies are pushed flat and the stop plates are flexed outward.

FIG. 3C shows the fracture of ligament 327 and the bending of leg 352 against stop plate 332. With even more gas production from combustible load 311, XTA 301 presses the pivot point of the shear plate assemblies 321 and 322 flat which bends stops plate 331 and 332 outwards as shown in FIG. 3D. The stretch of the bolts and bending of legs is mostly reversible so bolt stretch at 342 and legs 351 and 352 applies energy back to the XTA 301 which can then be applied to shearing other unfractured areas elsewhere down the length of the frangible joint.

Figure 3E:
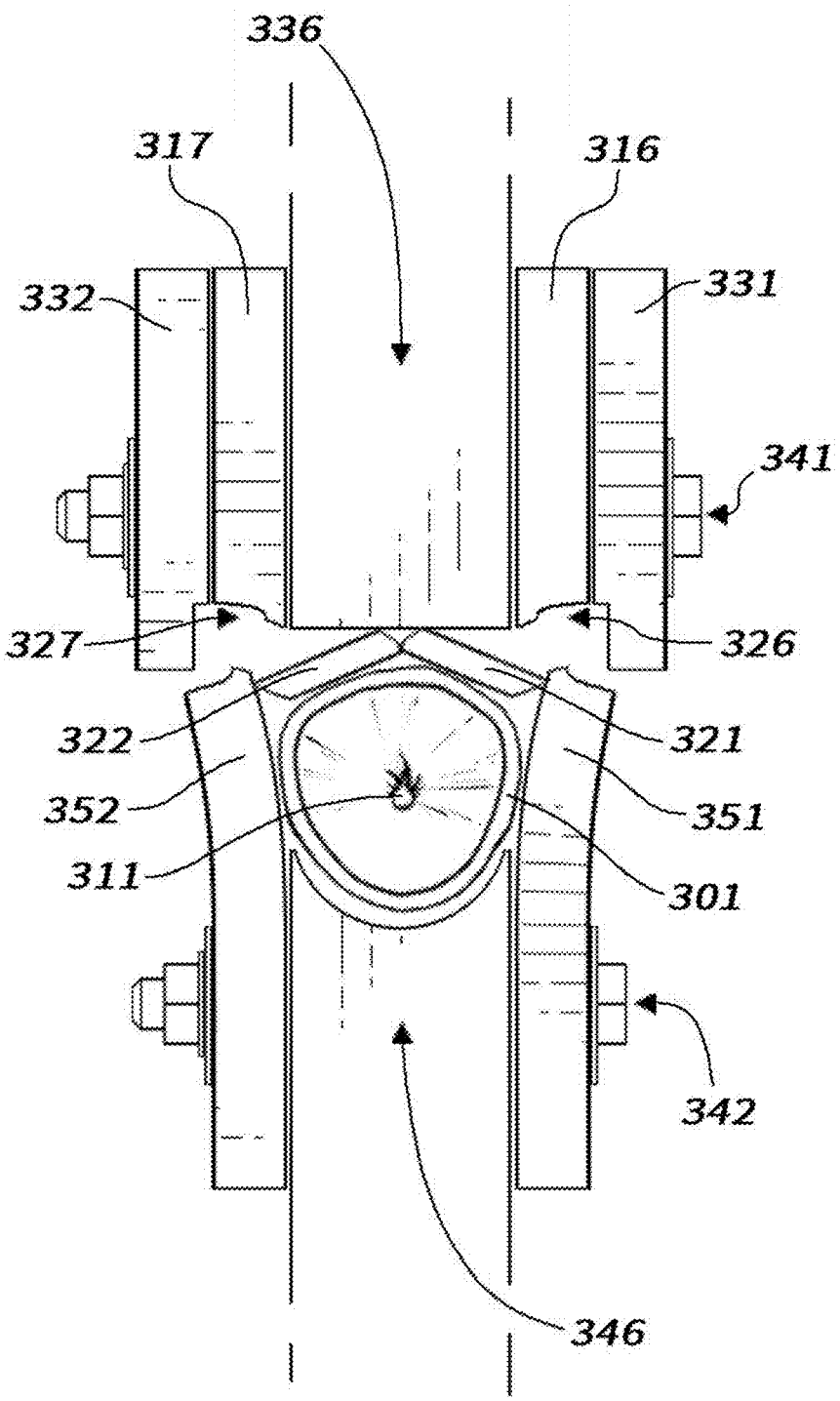
FIG. 3E is a view similar to that of FIG. 3D where XTA rounding continues and has pushed the upper and lower attachment portions away from each other.
Figure 3F:
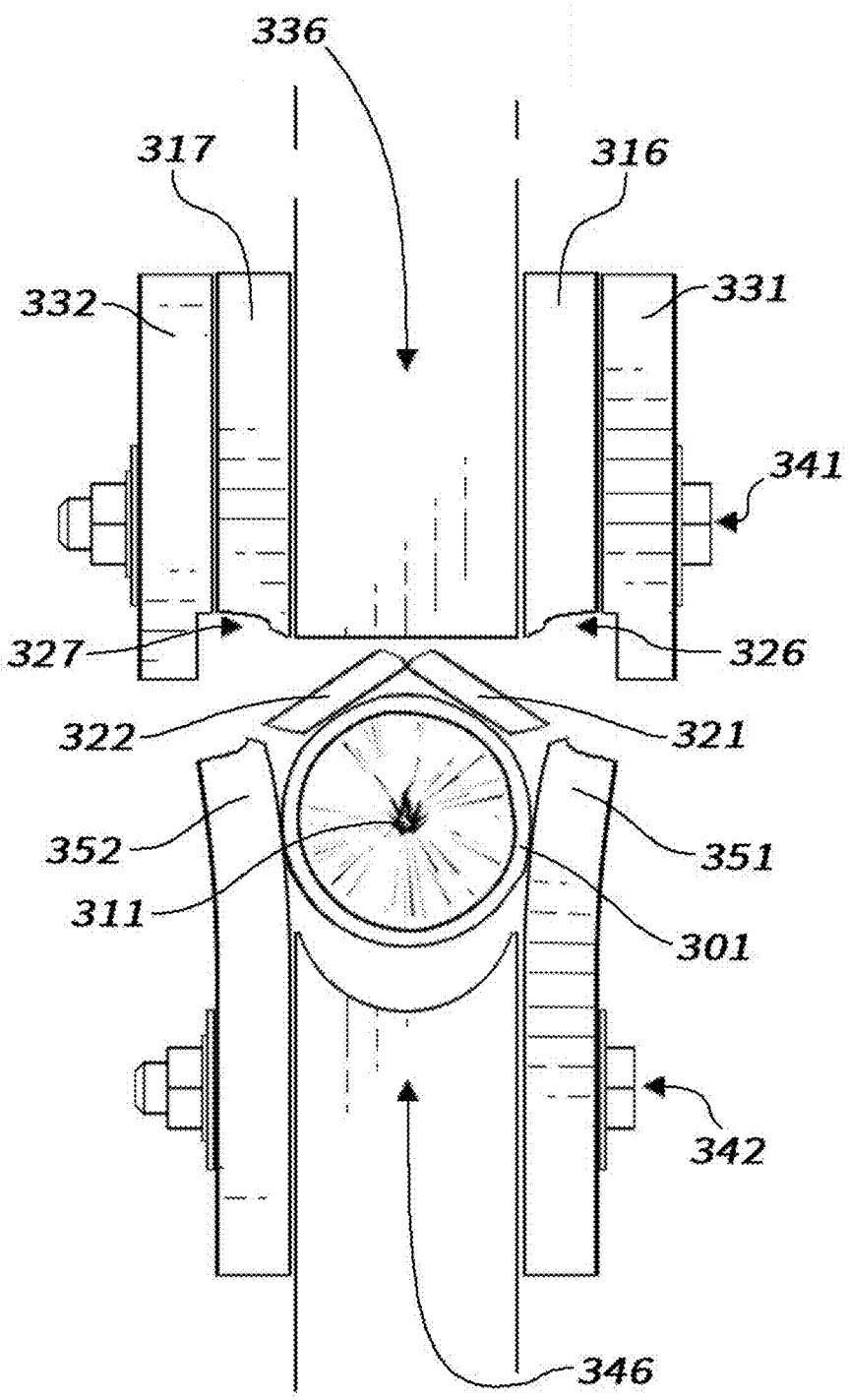
FIG. 3F is a view similar to that of FIG. 3E where XTA rounding has pushed the upper and lower attachment portions apart to the point where no contact between the two attachment portions exists.
Figure 4:
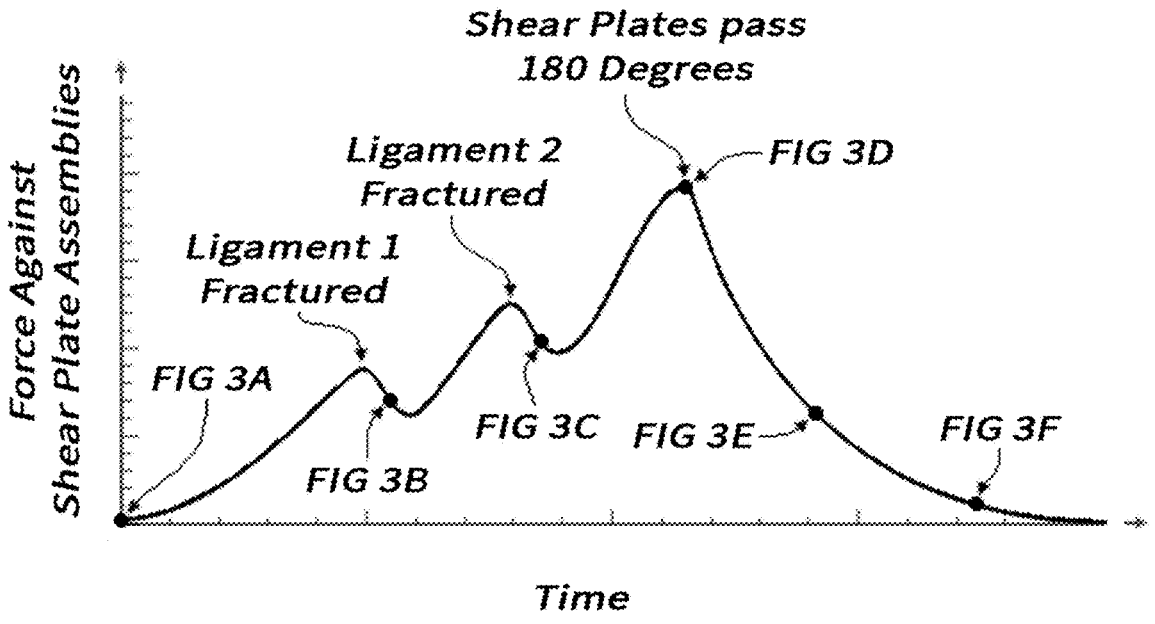
FIG. 4 is a diagram that plots force against the shear plate assemblies as a function of time, which shows the preferred sequence of ligament fracturing and push off events.
Figure 5:
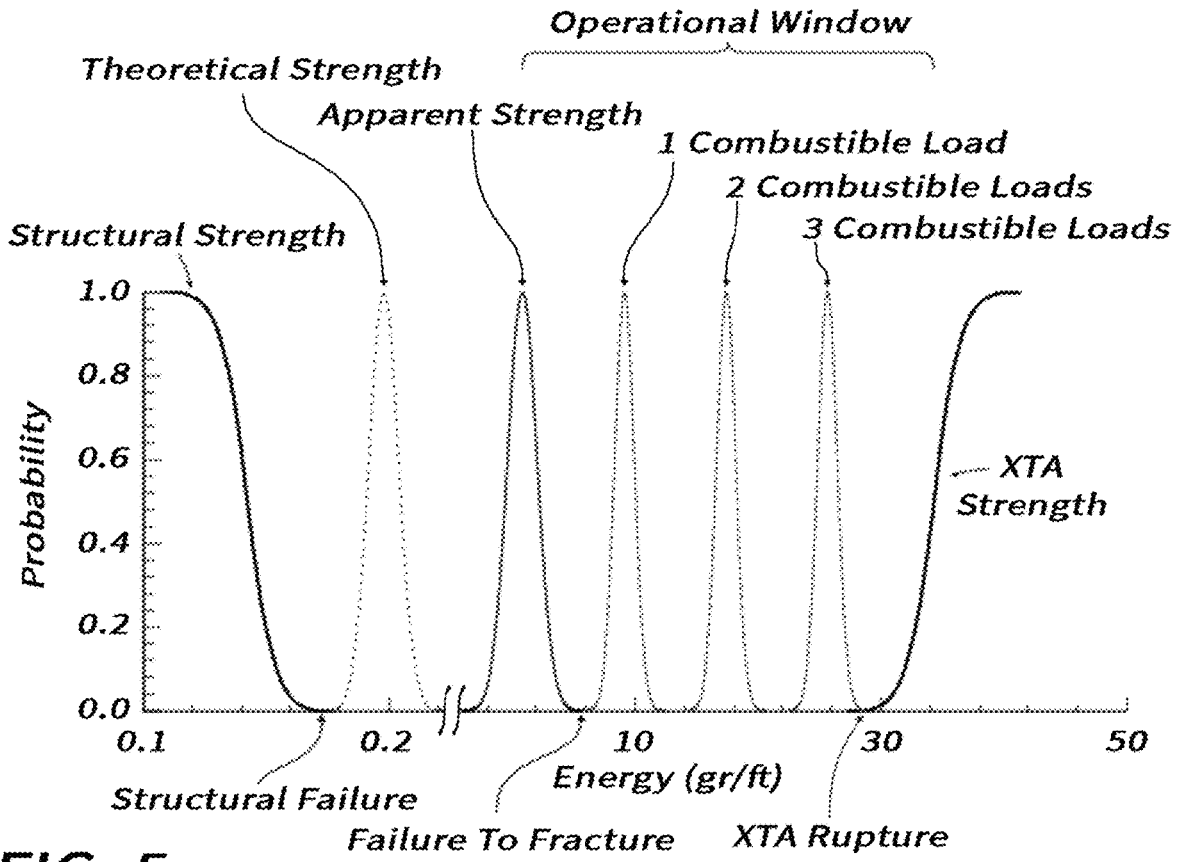
FIG. 5 is a reliability diagram of the present invention.

Once the continued inflation of XTA 301 has pivoted the shear plate assemblies 321 and 322 past 180 degrees, thrust separation begins. The pivot point now exerts force against the central plate 336 of the clevis assembly. This action forces disassociation between legs 351 and 352 and stop plates 331 and 332 as shown in FIG. 3E. At the same time stop plates 331 and 332 and legs 351 and 352 return some energy from elastic deformation which adds to thrust separation. Of course periodic means to keep XTA 301 and shear plate assemblies 321 and 322 attached to the lower tang 346 must be employed to prevent them from becoming space debris. FIG. 3F shows no further contact between the two stages.

Figure 6:
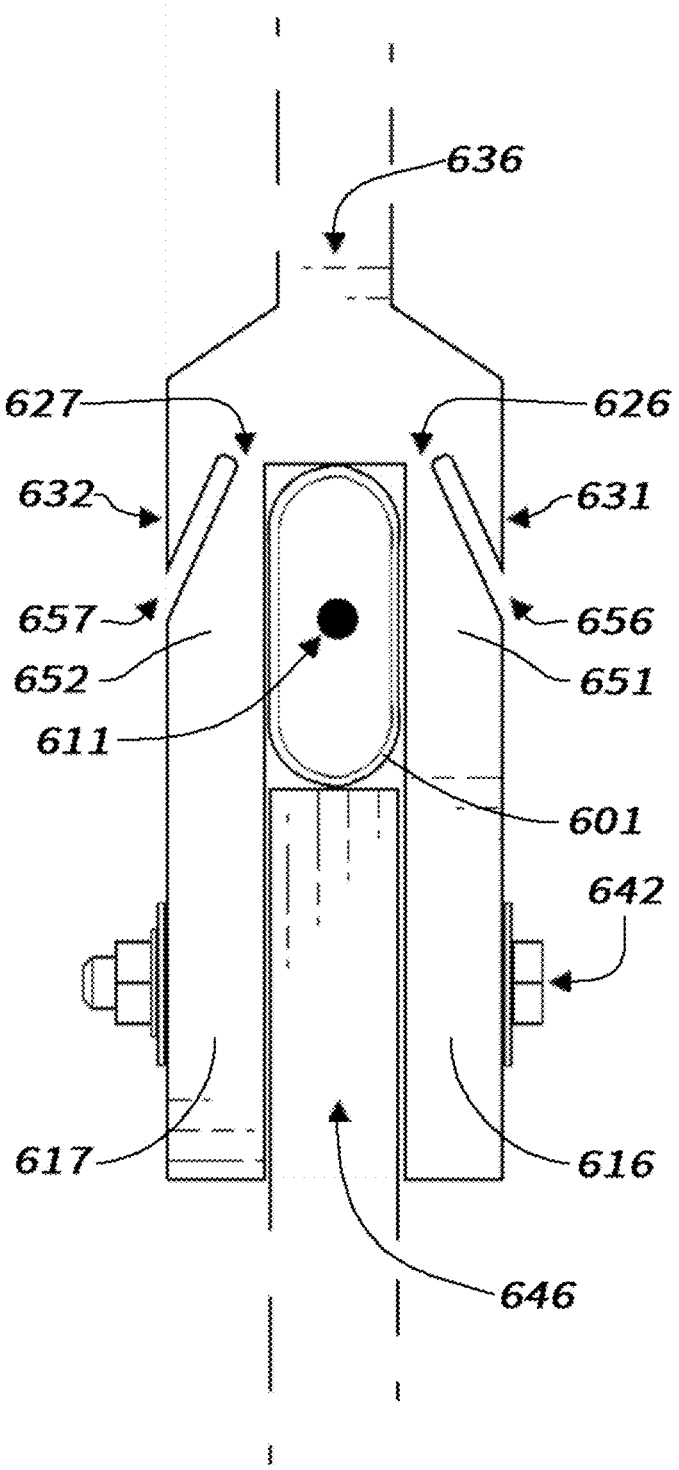
FIG. 6 is a partial cross-sectioned view of one embodiment of the present invention where one attachment portion, all frangible portions, and all movement stopping elements are all integral to one another, and utilizes the typical XTA configuration employed by prior art.

FIG. 6 represents another anticipated embodiment of the present invention, where the clevis 636, frangible portions 616 and 617, and stop plates 631 and 632 are all made integrally, and are bolted 642 to the lower tang 646. The XTA 601 is in the vertical major axis configuration commonly seen in prior art, where the inflation force of the XTA 601 is configured to apply force directly to the legs 651 and 652. The XTA 601 is shown having only one combustible load 611 due to the inefficiency of the XTA orientation and the lack of shear plate assemblies. This design is very similar to prior art in that it has the basic configuration, however by forming or cutting the grooves 656 and 657 to form ligaments 626 and 627 at an upward angle, instead of straight inward from the side as shown in FIG. 2A, stops 631 and 632 are automatically created. This configuration includes integral stops that are an improvement over prior art by conservation of combustion energy through limitation of unnecessary leg travel. This design will probably be such an improvement over prior art that reliability could be increased to 99.95% reliability.

Figure 7:
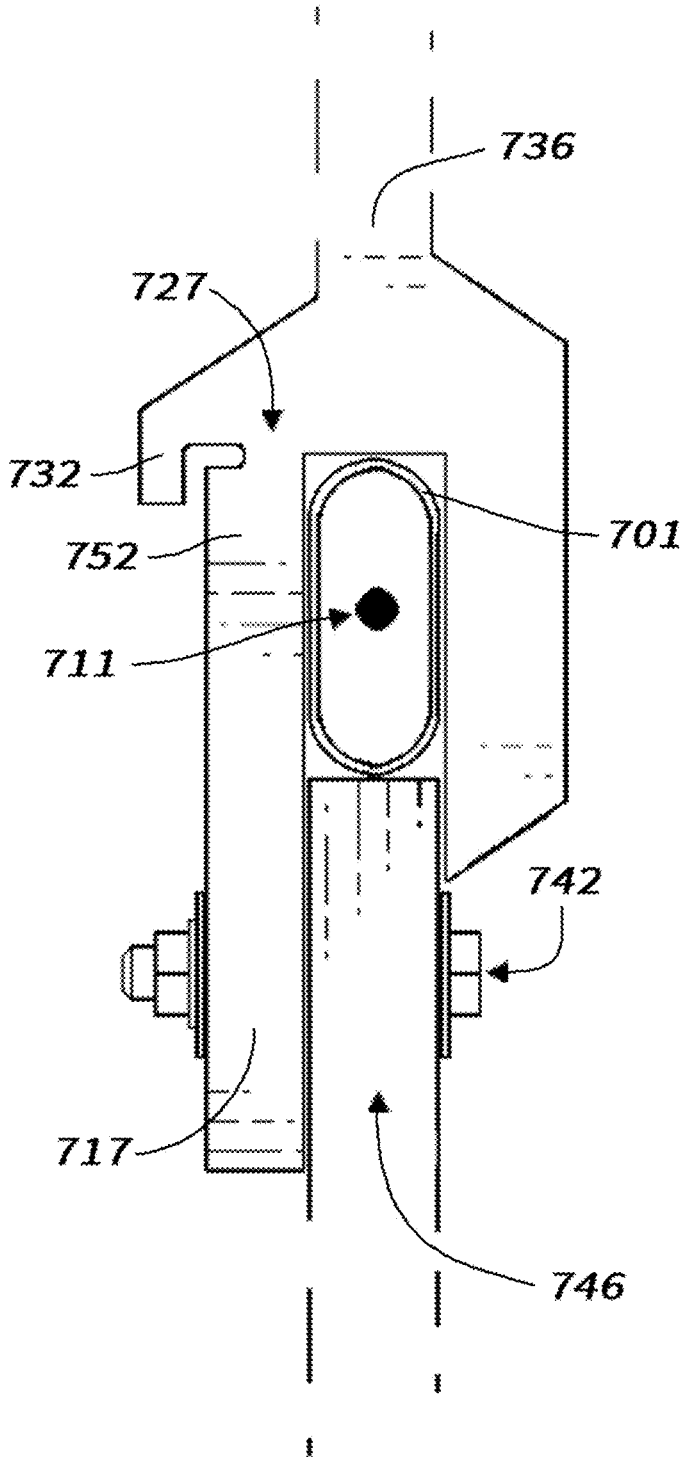
FIG. 7 is a partial cross-sectioned view of one embodiment of the present invention where the upper attachment portion and a single ligament design creates the expansion cavity, wherein the XTA is placed, and having a movement stopping element that is integral to the upper attachment portion.

Another anticipated variation of the present invention is shown in FIG. 7. This version demonstrates an embodiment of the present invention that only requires a single frangible portion 717, a single double strength ligament 727, and a single movement stopping element 732, which are all integrally formed together with the upper clevis plate 736, and bolted 742 to the lower tang plate 746. The stop plate 732 provides a large reliability increase through greater efficiency. Also present in this embodiment is the forming of the expansion cavity between the clevis 736, the single leg 752 of the frangible portion 717, and the lower tang plate 746, wherein the XTA 701, containing a single combustible load 711, is placed. Although FIG. 7 shows an inefficient XTA configuration, turning of the XTA 701 and the insertion of shear plate assemblies are also anticipated, and would allow for multiple combustible loads to therefore be utilized.

Figure 8:
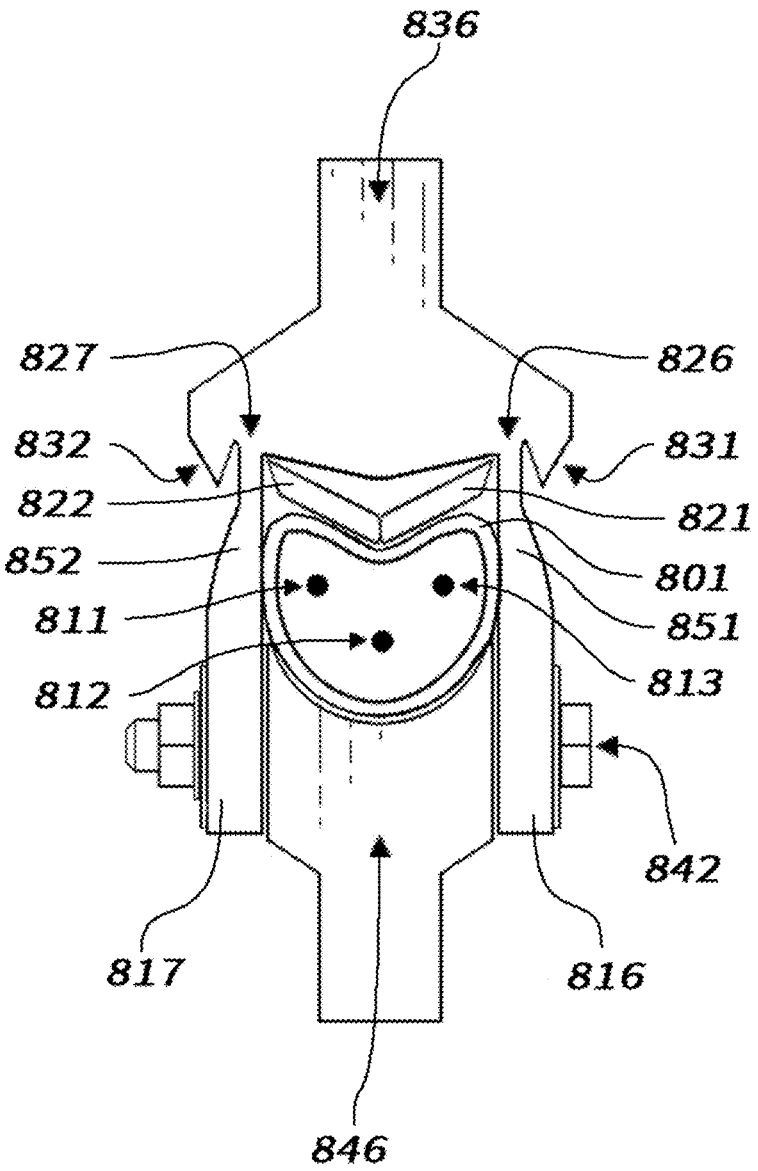
FIG. 8 is a partial cross-sectioned view of one embodiment of the present invention where one attachment portion, all frangible portions, and all movement stopping elements are integral to one another, and utilizes the XTA configuration of the present invention, shearing mechanism, and multiple combustible load redundancy.

Shown in FIG. 8 is another anticipated embodiment of the present invention. This configuration having the clevis 836, integrally formed with two frangible portions 816 and 817, ligaments 826 and 827, and post fracture movement stopping elements 831 and 832. Both frangible portions also have formed legs 851 and 852, that bolt 842 to the lower tang 846. This embodiment also utilizes the advantages of shear plate assemblies 821 and 822, a horizontal recurved XTA 801 containing three combustible loads 811, 812 and 813, and a lower tang 846 that has a curved shaped top to limit the expansion of the XTA in the undesirable lower corners of the expansion cavity, while also having a concave upper expansion cavity which provides customized post fracture timing and thrust separation force. This design is highly efficient at applying combustive energy to the main task of joint separation on both sides of an entire frangible joint section. That high efficiency in turn allows for multi-fault tolerance because of a wide operational window that allows for multiple combustible loads to be placed within the XTA. The integral stops provide a low mass means of stopping the post fracture leg movements. The tapered legs create launch stability by lessening the possibility of compressive buckling.

Figure 9:
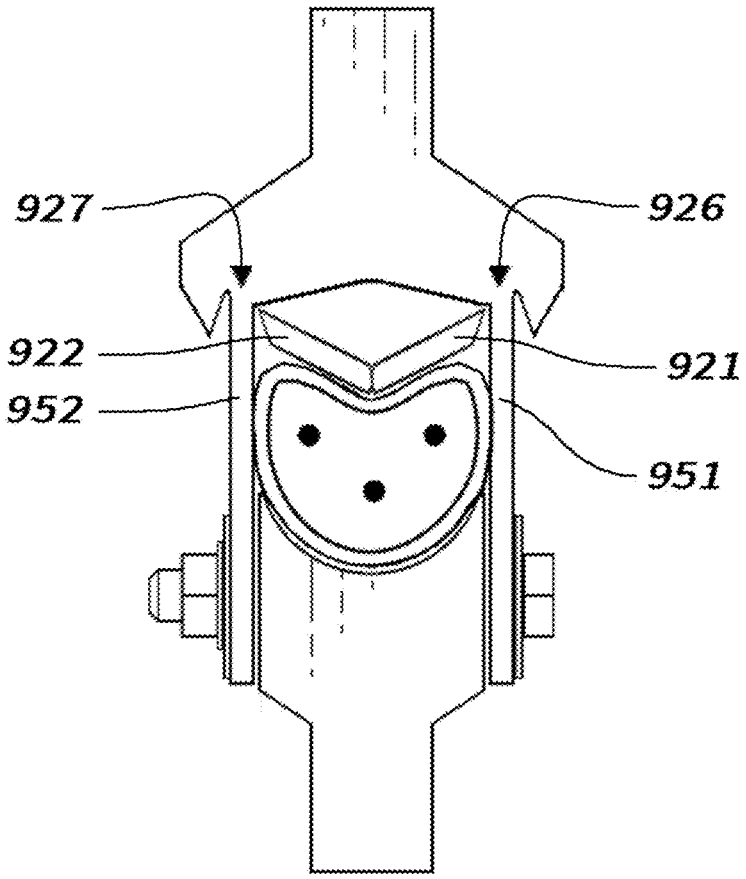
FIG. 9 is a partial cross-sectioned view of one embodiment of the present invention where one attachment portion, all frangible portions, and all movement stopping elements are integral to one another, and utilizes the XTA configuration of the present invention, shearing mechanism, and multiple combustible load redundancy, while also having thinner leg sections.

FIG. 9 features another anticipated embodiment similar to FIG. 8, wherein the legs 951 and 952 are the same thickness as the ligaments 926 and 927. With the use of shear plate assembles 921 and 922 in the present invention, which act as stress concentrators, stress risers in the form of a thinned sections are unnecessary. This design is highly efficient at applying combustion energy to the main task of joint separation on both sides of an entire frangible joint section. That high efficiency in turn allows for multi-fault tolerance because of a wide operating range that allows for multiple combustible loads to therefore be utilized.

Figure 10:
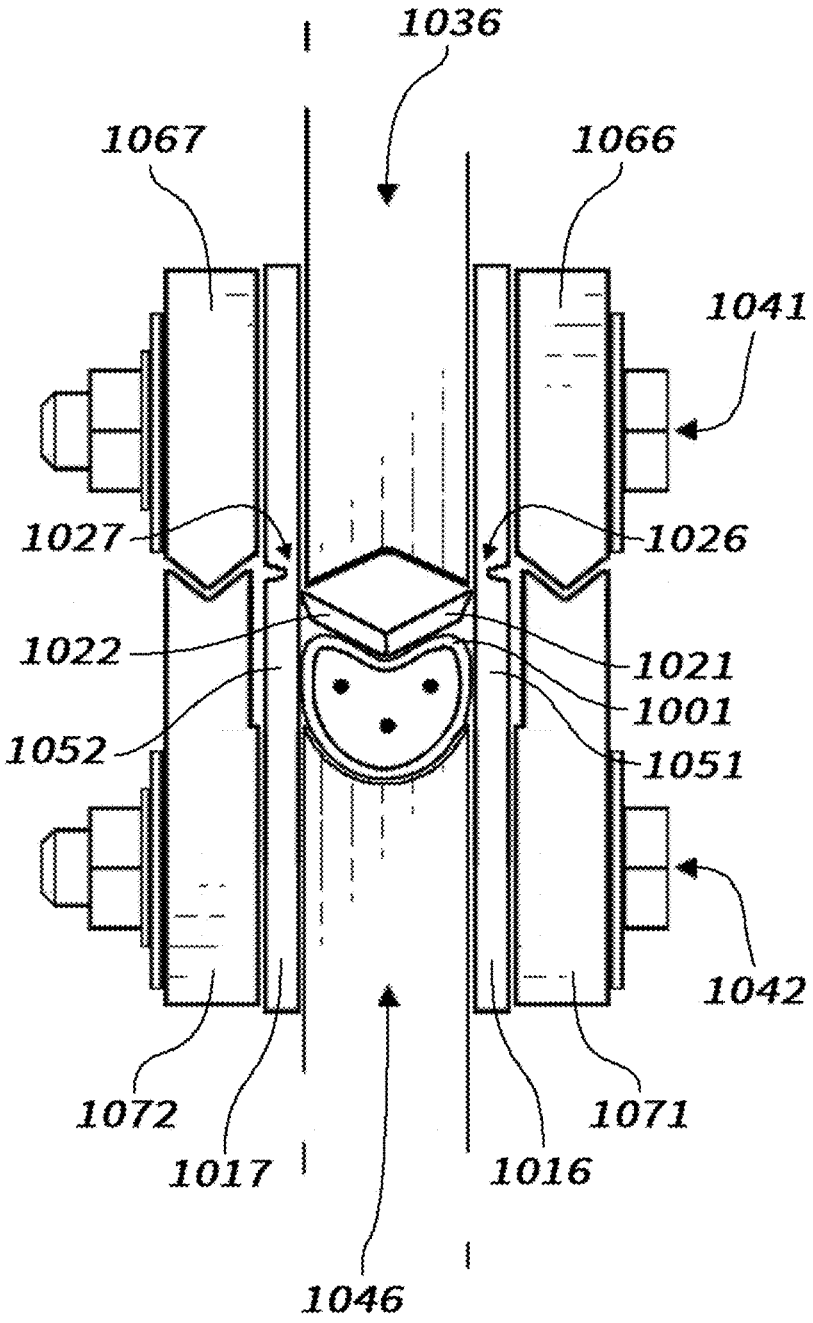
FIG. 10 is a partial cross-sectioned view of one embodiment of the present invention where the attachment portions, frangible portions, and movement stopping elements are all bolted together, and utilizes the XTA configuration of the present invention, shearing mechanism, multiple combustible load redundancy, and separates the compressive and tensile strength elements.

FIG. 10 shows another anticipated embodiment of the present invention. This variation features the physical separation of compressive and tensile elements. This configuration has an upper clevis assembly comprised of a clevis 1036, two frangible portions 1016 and 1017, ligaments 1026 and 1027, and upper compressive elements 1066 and 1067, that are all bolted 1041 together. This clevis assembly is bolted 1042 through the frangible portions 1016 and 1017 to the lower tang assembly. The lower tang assembly being comprised of the tang 1046, and two lower compressive elements 1071 and 1072. In this configuration the lower compressive elements 1071 and 1072 also act as the post fracture movement stopping elements for legs 1051 and 1052. This embodiment also utilizes the advantages of shear plate assemblies 1021 and 1022, and a horizontal recurved XTA 1001. This allows the frangible portions to share the compressive launch load with the compressive elements 1066, 1067, 1071 and 1072, and therefore can be lighter weight than other designs. This configuration is advantageous when the compression to tension launch load ratio is greater than one. That ratio is typically 3.5:1 for a Taurus XL rocket. Since the frangible portion of a rocket only applies to tension, there are opportunities for weight reduction. Both the combustible load and the XTA mass can be reduced. Also, since minimum shearing energy can be reduced by 3.5 fold through the separation of compressive and tensile elements, the shock impressed on the launch vehicle and payload during stage separation can also be reduced. In cases where the coefficient of friction between the legs 1051 and 1052 and the movement stopping elements is necessary to create a leveling effect down the length of the joint, the fractured legs should be stopped by the upper compressive elements 1066 and 1067. Conversely, if the free movement of the stages after ligament fracture is advantageous, the legs 1051 and 1052 should be stopped by the lower compressive elements 1071 and 1072. This design also allows for multi-fault tolerance because of a wide operating range that allows for multiple combustible loads to therefore be utilized.

Figure 11:
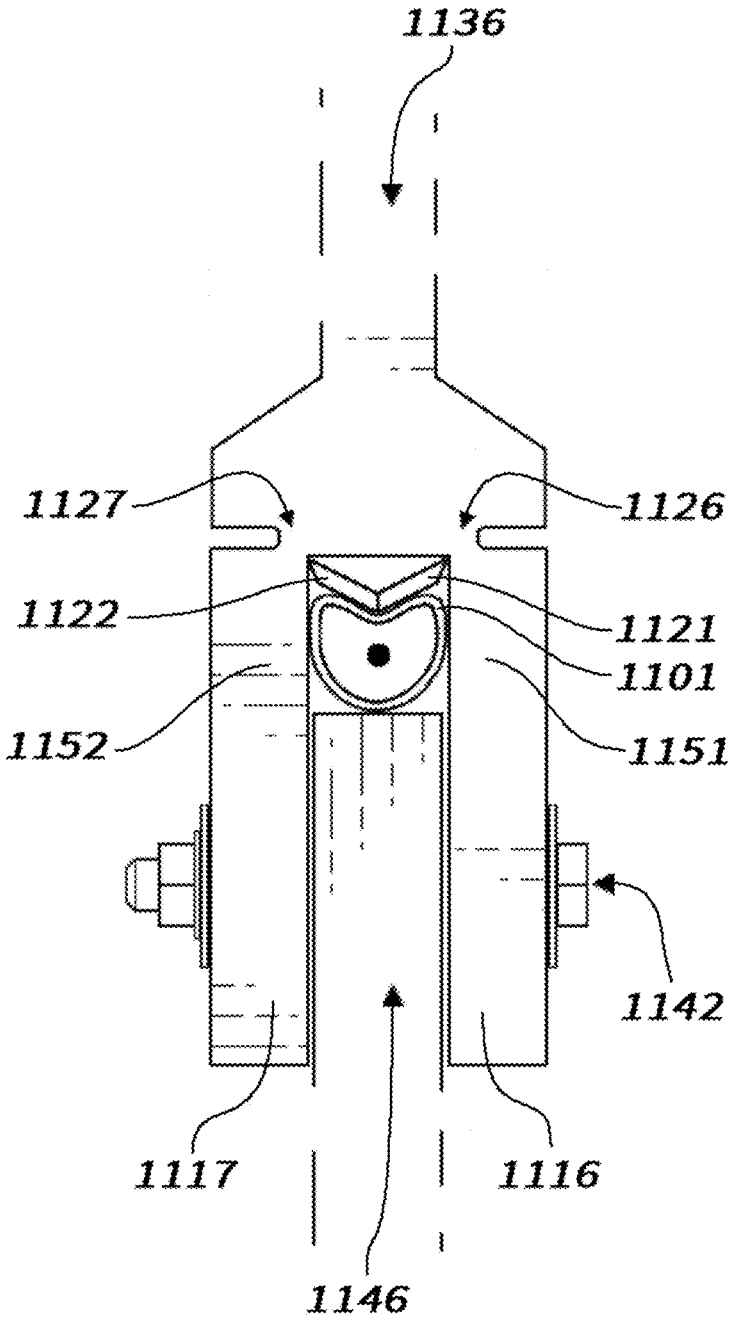
FIG. 11 is a partial cross-sectioned view of another embodiment of the present invention where one attachment portion, and all frangible portions, are all integral to one another, and utilizes the XTA configuration of the present invention, and shearing mechanism.

FIG. 11 illustrates another anticipated embodiment of the present invention, where the clevis 1136, and frangible portions 1116 and 1117 are all made integrally, and bolted 1142 to the lower tang 1146. This embodiment utilizes the advantages of shear plate assemblies 1121 and 1122, and a horizontal recurved XTA 1101. This design is efficient at applying combustive energy to the main task of shearing ligaments 1126 and 1127 and does provide a means of thrusting separation after fracture is complete.

Although exemplary embodiments of the invention have been shown and described, many other changes, modifications and substitutions, in addition to those set forth in the above paragraphs may be made by one having ordinary skill in the art without necessarily departing from the spirit and scope of this invention.

What is claimed:

1. A separation device assembly comprising:

A separation device having at least two attachment portions, at least one frangible portion, and at least one movement stopping element;

the attachment portions being arranged to fixedly connect to at least two separate structural components, with the attachment portions being joined to each other through at least one frangible portion, with at least one movement stopping element positioned as to confine the post-fracture movements of at least one frangible portion to between one tenth to sixty times the elongation limit of the fracture plane material;

wherein an expansion cavity is formed between at least one attachment portion and at least one frangible portion;

with at least one inflation device located within the expansion cavity;

further comprising at least one shear plate assembly which transfers and focuses inflation device force to, or near the desired fracture plane of at least one frangible portion.

2. The separation device assembly of claim 1, wherein the frangible portion or portions contain a groove or stress riser to facilitate fracturing.

3. The separation device assembly of claim 1, wherein at least one inflation device is inflated by at least one gas producing combustible load.

4. The separation device assembly of claim 1, wherein the shear plate assembly is integrally formed with at least one other shear plate assembly.

5. The separation device assembly of claim 4, wherein the shear plate assemblies have a thinner region between them that facilitates relative bending of the shear plate assemblies.

6. The separation device assembly of claim 1, wherein the shear plate assembly is affixed to at least one other shear plate assembly by means of a hinge.

7. The separation device assembly of claim 1, wherein the shear plate assembly is bonded to at least one other shear plate assembly.

8. The separation device assembly of claim 1, wherein the shear plate assembly has a point shaped tip.

9. The separation device assembly of claim 3, wherein an inflation device is configured to apply force against at least one shear plate assembly.

10. The separation device assembly of claim 9, wherein the inflation device is configured with a recurved groove along its axis.

11. The separation device assembly of claim 1, wherein at least one movement stopping element is affixed to at least one attachment portion with at least one fastener.

12. The separation device assembly of claim 1, wherein at least one movement stopping element is bonded to at least one attachment portion.

13. The separation device assembly of claim 1, wherein at least one movement stopping element is fastened to at least one frangible portion with at least one fastener.

14. The separation device assembly of claim 1, wherein at least one movement stopping element is bonded to at least one frangible portion.

15. The separation device assembly of claim 1, wherein at least one frangible portion is fastened to at least one attachment portion with at least one fastener.

16. The separation device assembly of claim 1, wherein at least one frangible portion is bonded to at least one attachment portion.

17. A method of separating portions of a structure at all locations along a three dimensional separation assembly, the method comprising:

an inflation device deposited inside an expansion cavity used to fracture frangible portions, and also providing a stopping means which confines post fracture movements of any frangible portions to between one tenth to sixty times the elongation limit of the fracture plane material;

further comprising at least one shear plate assembly which transfers and focuses inflation device force to, or near the desired fracture plane of at least one frangible portion.

18. The method of claim 17, wherein the inflation device is configured with a recurved groove along its axis.

19. The method of claim 17, wherein the inflation device and expansion cavity are configured to apply thrusting force between the separated structures after complete fracturing of all frangible portions has occurred.

* * * * *